US010014633B1

(12) United States Patent
Choi et al.

(10) Patent No.: US 10,014,633 B1
(45) Date of Patent: Jul. 3, 2018

(54) CONNECTOR DEVICE FOR FUEL INJECTION DEVICE

(71) Applicants: HYUNDAI MOTOR COMPANY, Seoul (KR); KIA MOTORS CORPORATION, Seoul (KR); SUMITOMO WIRING SYSTEMS, LTD., Mie-prefecture (JP)

(72) Inventors: Choo Saeng Choi, Seongnam-si (KR); Minho Lee, Seongnam-si (KR); Hideto Nakamura, Yokkaichi (JP)

(73) Assignees: HYUNDAI MOTOR COMPANY, Seoul (KR); KIA MOTORS CORPORATION, Seoul (KR); SUMITOMO WIRING SYSTEMS, LTD., Mie-Prefecture, Kokkaichi (KR)

( * ) Notice: Subject to any disclaimer, the term of this patent is extended or adjusted under 35 U.S.C. 154(b) by 0 days.

(21) Appl. No.: 15/717,770

(22) Filed: Sep. 27, 2017

(30) Foreign Application Priority Data

Apr. 3, 2017 (KR) ..... 10-2017-0042859

(51) Int. Cl.
*H01R 13/627* (2006.01)
*H01R 13/641* (2006.01)
*H01R 25/00* (2006.01)

(52) U.S. Cl.
CPC ..... *H01R 13/641* (2013.01); *H01R 25/003* (2013.01)

(58) Field of Classification Search
CPC ..... H01R 13/6272; H01R 13/635; H01R 13/633; H01R 103/00; H01R 13/641
USPC ..... 439/352, 159, 923, 188, 489
See application file for complete search history.

(56) References Cited

U.S. PATENT DOCUMENTS 7,131,854 B1 * 11/2006 Pavlovic ..... H01R 13/6273 439/352
7,232,329 B1 * 6/2007 Wu ..... H01R 12/62 439/358
7,334,572 B1 2/2008 Diggs et al.
7,578,693 B2 * 8/2009 Yoshida ..... H01R 13/627 439/352
7,874,858 B2 * 1/2011 Atsumi ..... H01R 9/03 439/248

(Continued)

FOREIGN PATENT DOCUMENTS

EP 2161441 A1 3/2010
JP 2015034466 A 2/2015

(Continued)

*Primary Examiner* — Phuong Chi T Nguyen
(74) *Attorney, Agent, or Firm* — McDermott Will & Emery LLP

(57) ABSTRACT

A connector device with improved workability in moving a detecting member to a detecting position may include a plurality of connectors configured to be fitted to a plurality of mating connectors, a detecting member arranged movably to a standby position or a detecting position with respect to the plurality of connectors and allowed to move to the detecting position when the plurality of connectors are normally fitted to the plurality of mating connectors, a holder configured to hold the plurality of connectors in parallel and an operation member capable of collectively moving the detecting member individually disposed in the plurality of connectors to the detecting position.

4 Claims, 31 Drawing Sheets

(56) References Cited

U.S. PATENT DOCUMENTS

| | | | | |
|---|---|---|---|---|
| 9,525,238 | B1 * | 12/2016 | Luksic | H01R 13/633 |
| 2009/0241904 | A1 | 10/2009 | Sugiyama et al. | |

FOREIGN PATENT DOCUMENTS

| | | | |
|---|---|---|---|
| JP | 2015215985 | A | 12/2015 |
| JP | 2016079836 | A | 5/2016 |

* cited by examiner

CONNECTOR DEVICE FOR FUEL INJECTION DEVICE

CROSS-REFERENCE TO RELATED APPLICATIONS

The present application is based on and claims the benefit of priority to Korean Patent Application No. 10-2017-0042859, filed on Apr. 3, 2017 with the Korean Intellectual Property Office, the entire disclosure of which is incorporated herein by reference.

TECHNICAL FIELD

The present disclosure relates to a connector device having a connector and a holder.

BACKGROUND

A fuel injection device disclosed in Patent Document 1 has two injector main bodies installed in parallel in a single cylinder of an internal combustion engine, a power receiving connector provided in each injector main body, and a power feed connector which can be fitted to each power receiving connector.

The connector disclosed in Patent Document 2 includes a connector housing that can be engaged with the mating connector and a detecting member which is movably mounted to the connector housing at the standby position and the detecting position and is allowed to move to the detecting position when the connector housing is normally fitted with the mating connector. According to this, it can be judged that when the detecting member is movable, the connector housing is normally fitted with mating connector.

Patent Document 1 (JP 2015-034466 A)

Patent Document 2 (JP 2015-215985 A)

SUMMARY

By inserting the detecting member disclosed in Patent Document 2 in the power receiving connector disclosed in Patent Document 1, it is possible to know whether or not the power receiving connector is normally fitted to the power receiving connector by whether or not the detecting member can be moved.

However, for example, in the case of the four-cylinder engine of the internal combustion engine disclosed in Patent Document 1, since eight power receiving connectors are provided, when the detecting members of Patent Document 2 are inserted into each power receiving connector, connector fitting operation should be performed eight times in total, resulting in a large workload.

The present disclosure has been developed to overcome the problem, and an object of the present disclosure is to improve workability in moving the detecting member to the detecting position.

In accordance with an aspect of the present disclosure, a connector device includes a plurality of connectors configured to be fitted to a plurality of mating connectors, a detecting member configured to move to a standby position or a detecting position with respect to the plurality of connectors and to move to the detecting position when the plurality of connectors are fitted normally to the plurality of mating connectors, a holder configured to hold the plurality of connectors in parallel and an operation member capable of collectively moving the detecting member individually disposed in the plurality of connectors to the detecting position.

The plurality of connectors are held side by side in the holder, and in this state, the detecting members individually disposed in the respective connectors are moved collectively to the detecting position by the operating member.

Therefore, it is not necessary to perform the movement operation of the detecting member for each connector, and workability in moving the detecting member to the detecting position can be improved.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
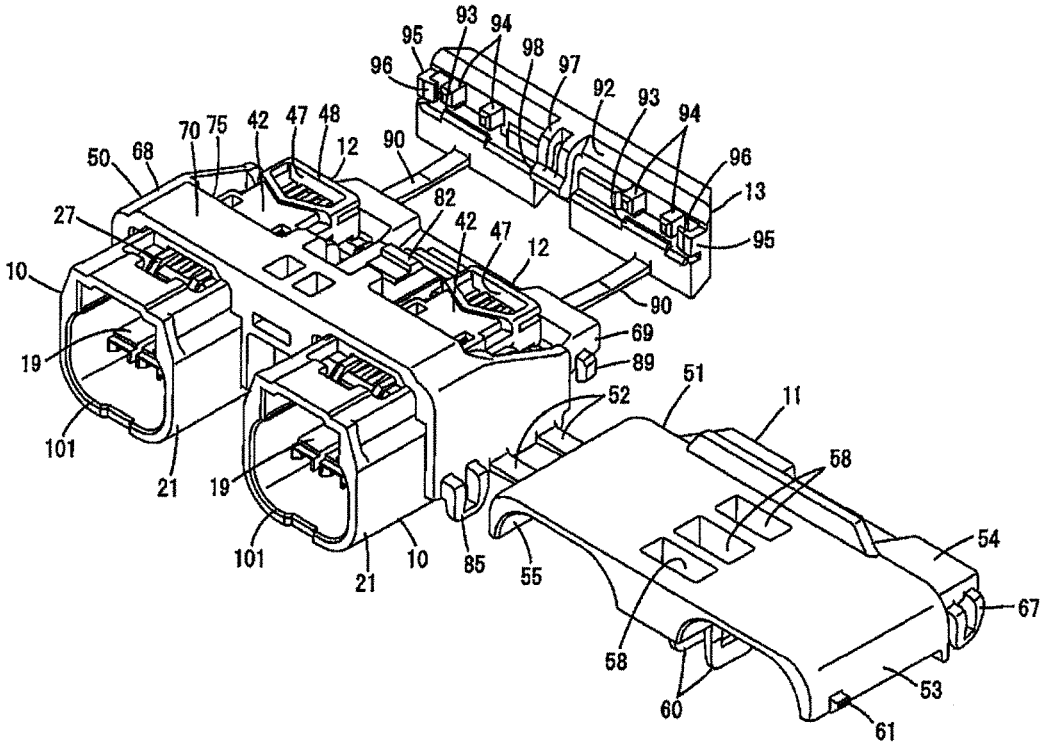
FIG. 1 is a perspective view showing a state in which two connectors are held in an upper holder in a connector device according to an embodiment of the present disclosure.

Preferred embodiments of the present disclosure will be described below.

Stopping portions that engage with each other when the detecting member is moved to the detecting position may be provided on mutually opposing surfaces of the operation member and the detecting member. According to this, when the detecting member is moved to the detecting position by the operating member, the mutually opposing surfaces of the operating member and the detecting member are prevented from being displaced. Therefore, the operability when the operating member presses the detecting member can be improved.

The holder or the connector may include a sound generating portion, and the operating member may have a striking portion that reaches the press-in position when the detecting member is moved to the detecting position and strikes the sound generating portion at the press-in position to generate a sound. When the detecting member is moved to the detecting position and the operating member reaches the press-in position, the striking portion may strike the sound generating portion to cause the sound. Therefore, it can be confirmed that the detecting member is moved to the detecting position by recognizing the sound.

The striking portion may be a locking piece that is engaged with the holder or the connector and restricts the operating member from moving in the returning direction from the press-in position. When the operating member reaches the press-in position, the locking piece, which is the striking portion, is engaged with the holder or the connector, and movement of the operating member in the returning direction from the press-in position is restricted. Therefore, the function of generating the sound and the function of restricting the return movement of the operating member are integrally provided in the striking portion. As a result, the configuration can be simplified as compared with the case where the two functions (the function of generating sound and the function of restricting the return movement) are separately provided.

The operating member may be connected to the holder through a hinge. According to this, the number of parts is reduced as compared with the case where the operating member and the hinge are separated from each other.

First Embodiment

Hereinafter, a first embodiment of the present disclosure will be described with reference to the drawings. A connector device according to the first embodiment may include a connector 10, a holder 11, a detecting member 12, an operating member 13, and a terminal fitting 14. The connector 10 may be fitted to a mating connector 15 provided in a standby state on an injector (fuel injection valve) of a vehicle engine (not shown). Two injectors may be installed in parallel in one cylinder. The mating connector 15 may be installed individually in each injector.

A plurality of connectors 10 (two connectors per cylinder) may be provided to correspond to a plurality of mating connectors 15. The holder 11 may hold the two connectors 10 side by side. As will be described later, the respective connectors 10 may be collectively fitted to the corresponding mating connectors 15 through the holder 11. The detecting member 12 may be movably attached to the connectors 10 from the standby position to the detecting position. The operating member 13 may be a member for pushing the detecting member 12 and moving it to the detecting position. In the following description, in regard of front and rear directions, a direction in which the connector 10 faces the mating connector 15 at the start of engagement is a front direction. The vertical direction is based on FIG. 1 to FIG. 5, and the horizontal direction is based on FIG. 3.

Figure 12:
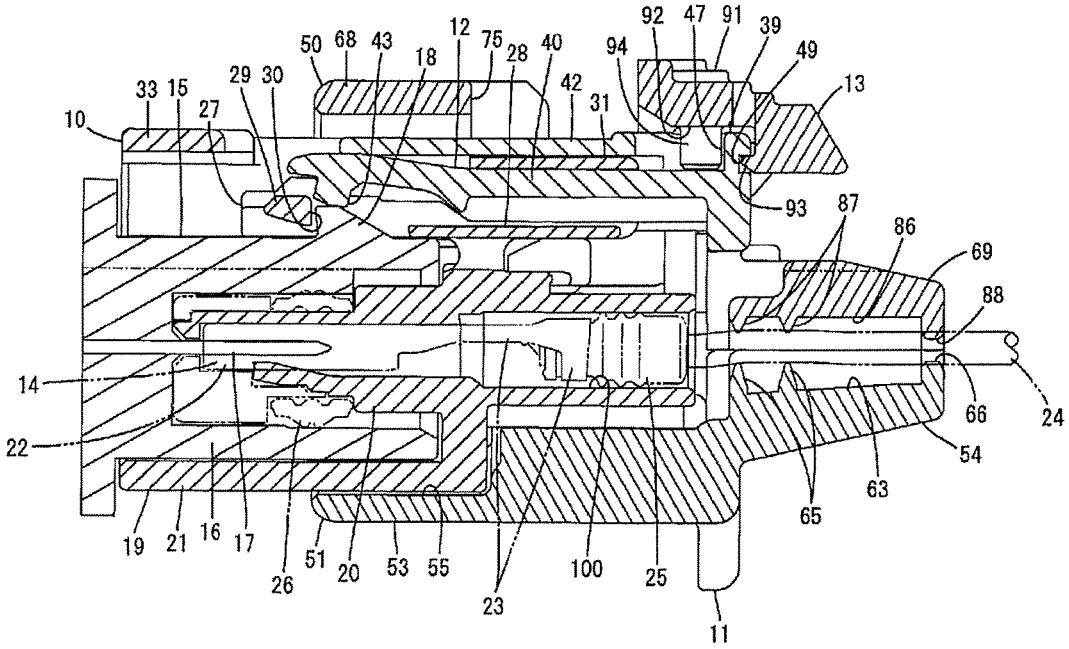
FIG. 12 is a side sectional view showing a state in which a connector is normally fitted to the corresponding mating connector according to an embodiment of the present disclosure.

The mating connector 15 may be equipped with a hood portion 16 made of a synthetic resin. As shown in FIG. 12, a tub 17 of a mating terminal fitting may protrude in the hood portion 16. A mating locking portion 18 may protrude from the upper outer wall of the hood portion 16.

Figure 22:
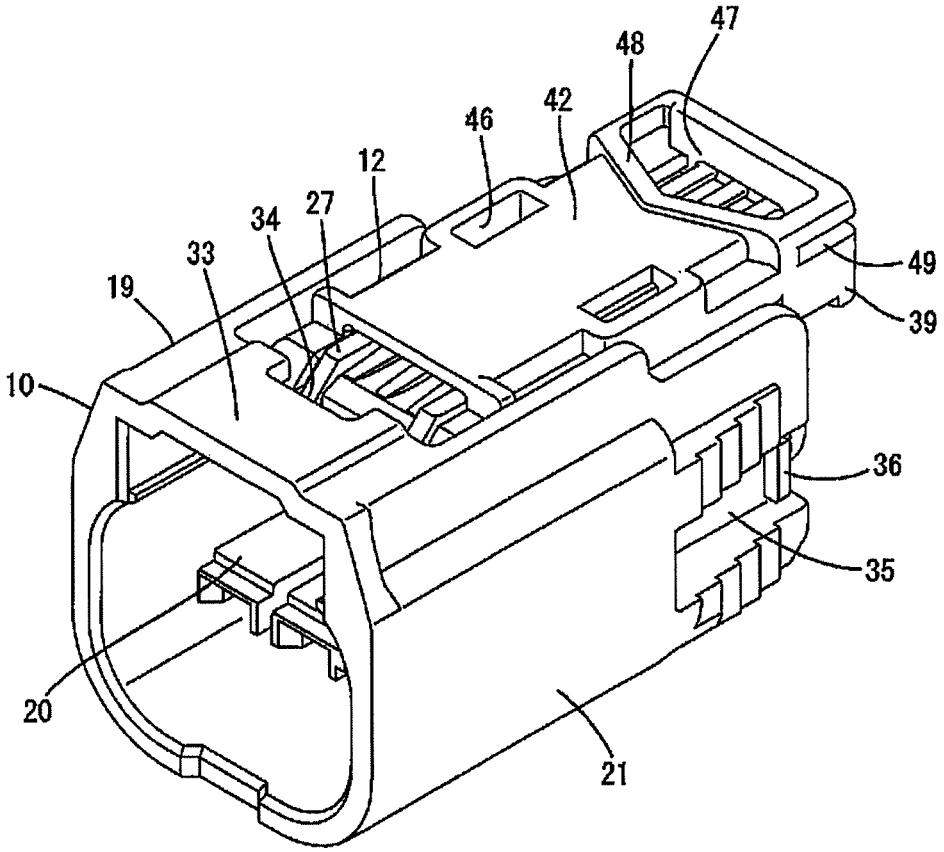
FIG. 22 is a perspective view of a connector in which a detecting member is held in a standby position according to an embodiment of the present disclosure.
Figure 23:
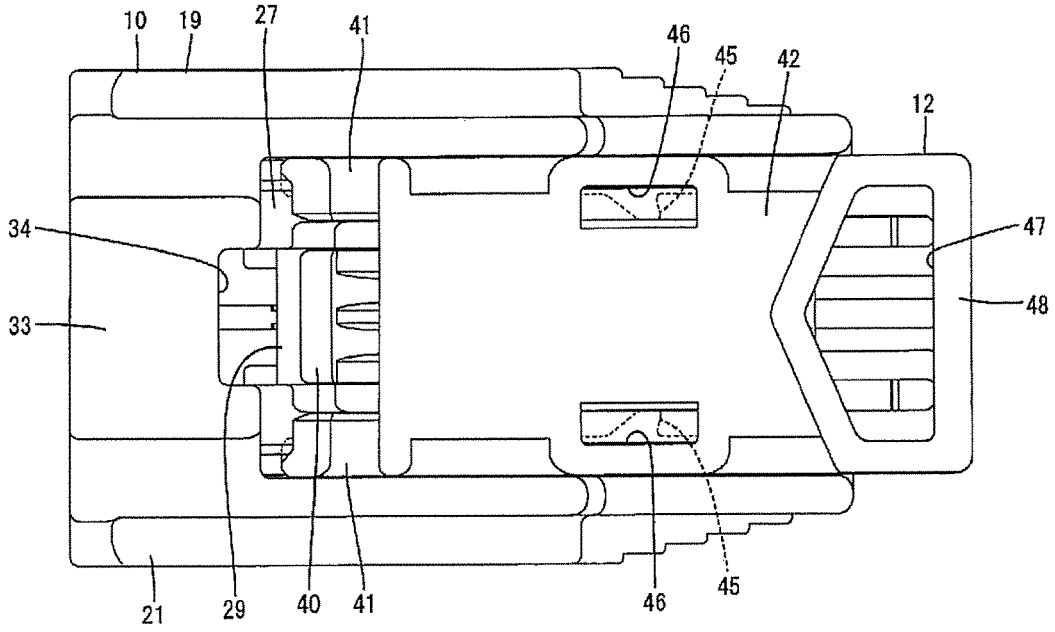
FIG. 23 is a plan view of FIG. 22.
Figure 24:
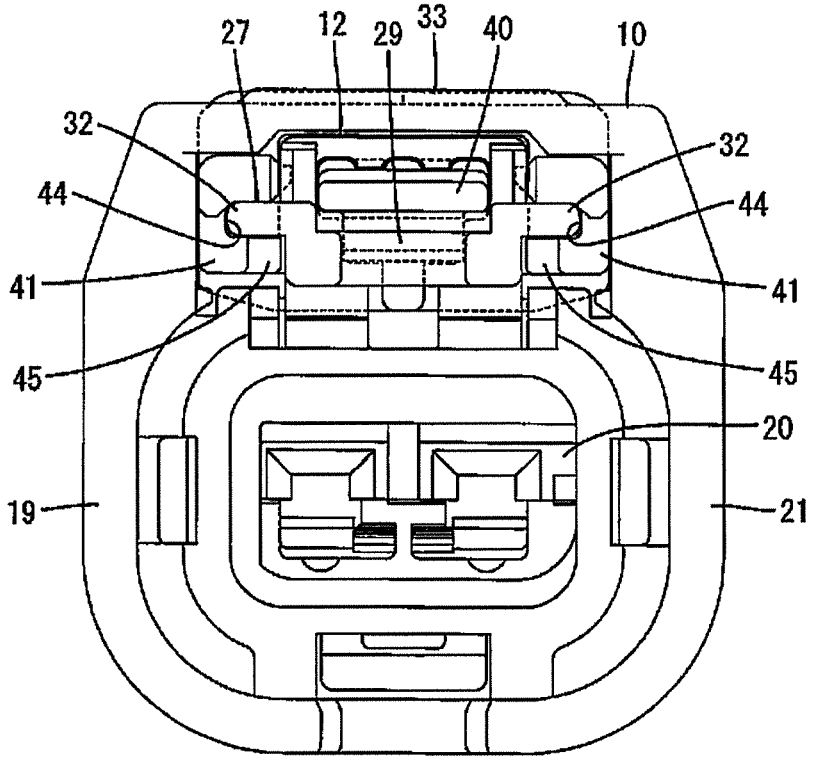
FIG. 24 is a front view of FIG. 22.

The connector 10 may be equipped with a connector housing 19 made of a synthetic resin. As shown in FIGS. 22 to 24, the connector housing 19 may include a block-shaped housing main body 20, and a fitting tube portion 21 surrounding the outer circumference of the housing main body 20.

As shown in FIG. 12, the terminal fitting 14 may be inserted into a cavity 100 of the housing main body 20 from behind. The terminal fitting 14 may be made of metal, and may have a connecting portion 22 and a barrel portion 23 located behind the connecting portion 22. The connecting portion 22 may be in the shape of a cylinder. The tub 17 of the mating terminal fitting mounted on the mating connector 15 may be inserted into the connecting portion 22 and connected to the connecting portion 22. The barrel portion 23 may be in the shape of an open barrel, and may be press-connected to one end of an electric wire 24. In addition, the barrel portion 23 may be press-connected to a rubber stopper 25 which is externally fitted to the electric wire 24. When the terminal fitting 14 is normally inserted into the cavity 100, the rubber stopper 25 may be elastically brought into close contact with the rear end of the inner circumferential surface of the cavity 100 so that the electric wire 24 is taken out of the rear surface of the housing main body 20. The electric wire 24 may be a covered wire surrounding a core wire with an insulating resin.

A seal ring 26 may be mounted on the outer circumference of the housing main body 20. When the connector 10 is fitted to the mating connector 15, the seal ring 26 may be inserted between the housing main body 20 and the hood portion 16 to seal space between the connector 10 and the mating connector 15.

Figure 10:
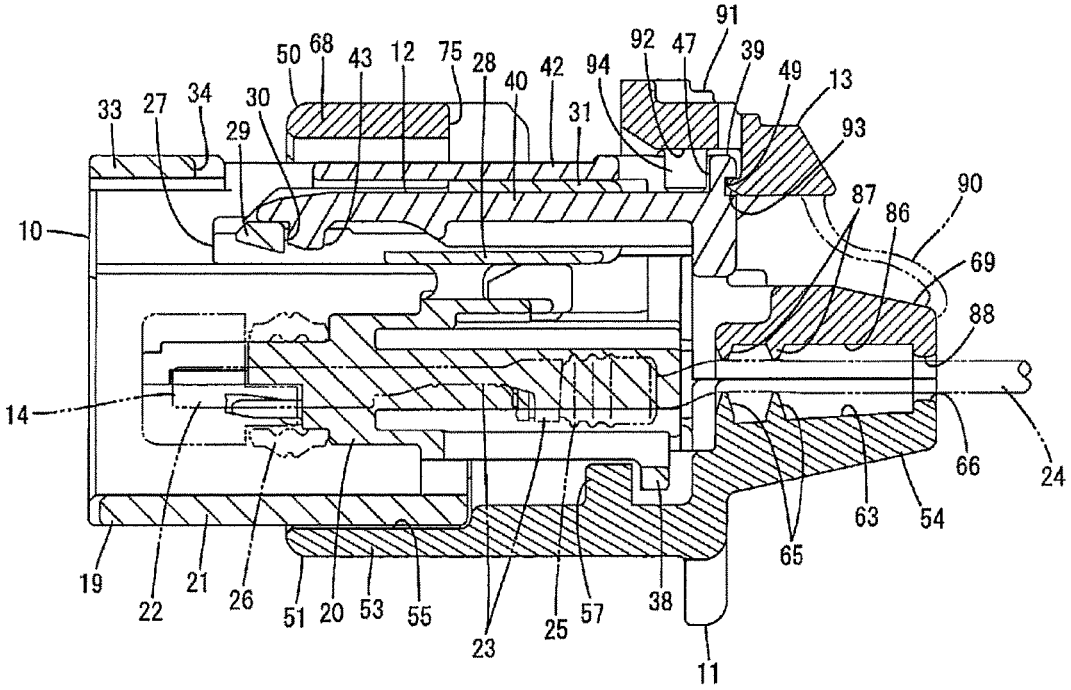
FIG. 10 is a sectional view cut along a line X-X in FIG. 8.
Figure 26:
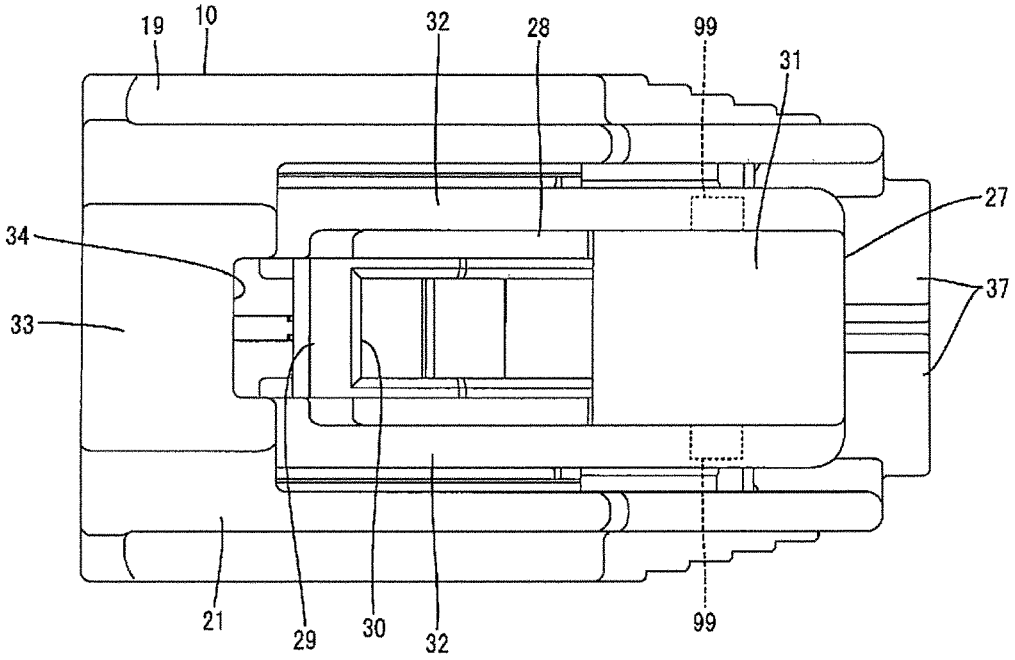
FIG. 26 is a plan view of the connector of FIG. 22.

As shown in FIGS. 10 and 26, a locking arm 27 may be connected to the upper surface of the housing main body 20. The locking arm 27 may include an arm portion 28 extending in the front-rear direction, and can be vertically bent. The arm portion 28 may include a locking body portion 29 at the front end, and a locking hole 30 penetrating in the vertical direction may be formed in the rear side of the locking body portion 29. In addition, the arm portion 28 may have a flat plate-shaped upper plate portion 31 at the rear portion. The upper plate portion 31 may be disposed to cover the rear upper portion of the locking hole 30. The arm portion 28 may include a pair of rail portions 32 extending in the front-rear direction at the left and right edges, and have a pair of leg portions 99 below the pair of rail portions 32.

The upper wall of the fitting tube portion 21 may include a wall portion 33 at the front end, and an opening portion 34 at the back of the wall portion 33. Before the detecting member 12 is attached, the locking arm 27 may be exposed to the upper side through the opening portion 34.

Figure 6:
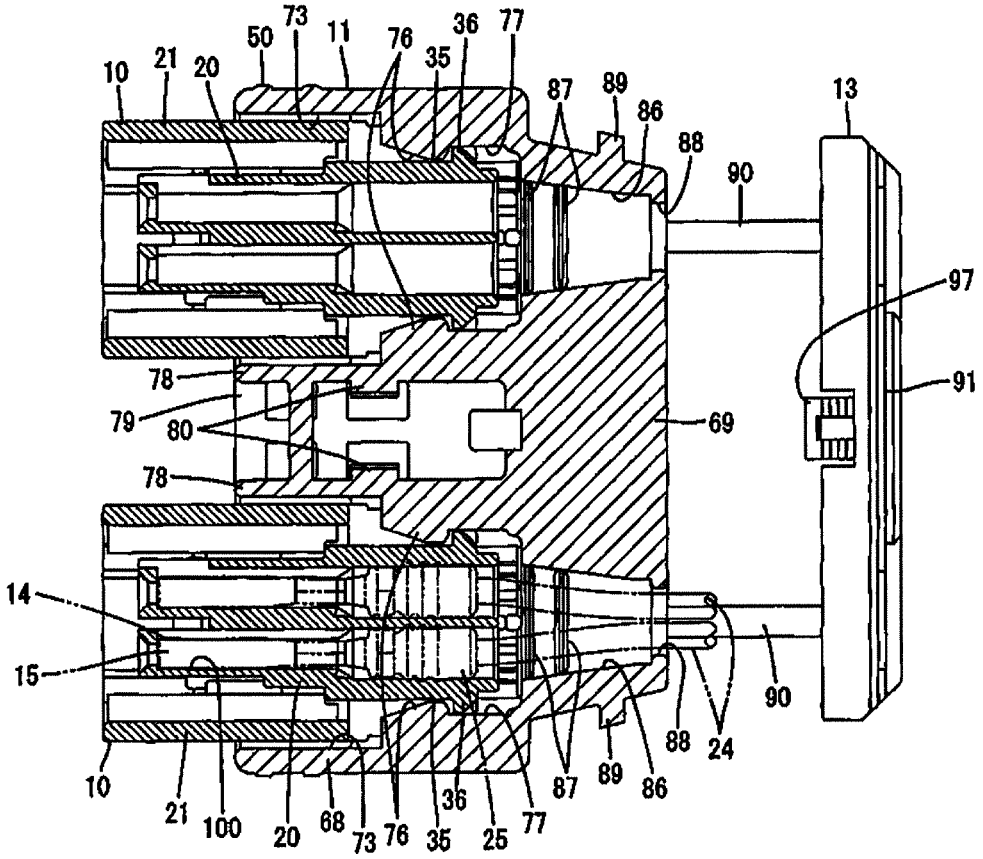
FIG. 6 is a cross-sectional view (cross-sectional view in a horizontal direction) of FIG. 2.
Figure 25:
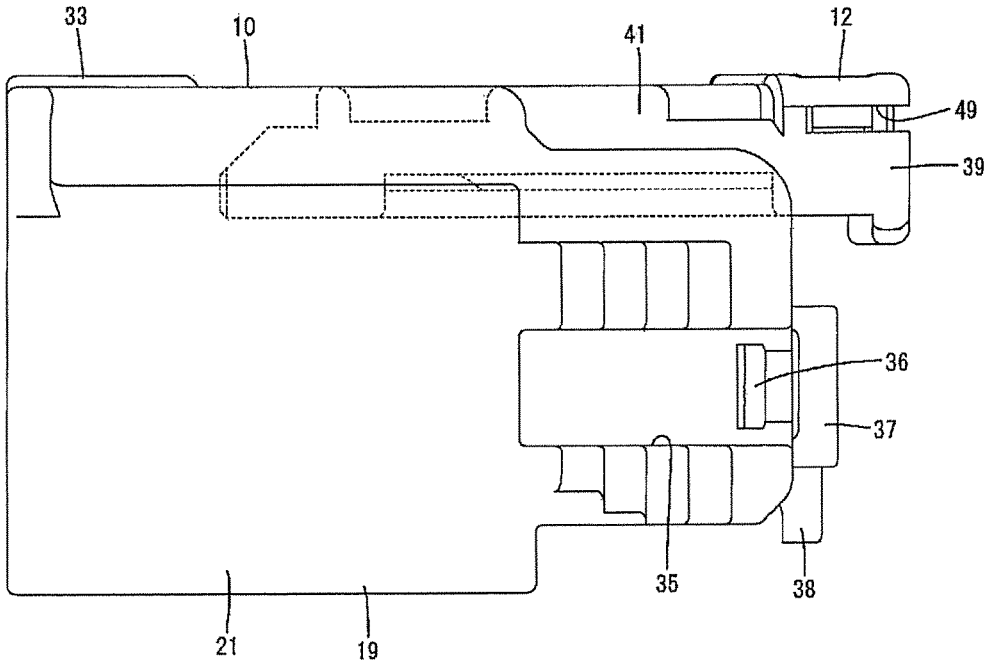
FIG. 25 is a side view of FIG. 22.

As shown in FIGS. 6 and 25, both side walls of the fitting tube portion 21 may have a pair of locking grooves 35 on the outer surface of the rear end portion. The locking groove 35 may extend in the front-rear direction to open the rear end of a side wall. Both side walls of the fitting tube portion 21 may have a pair of locking projections 36 at the rear end of the locking groove 35.

Figure 11:
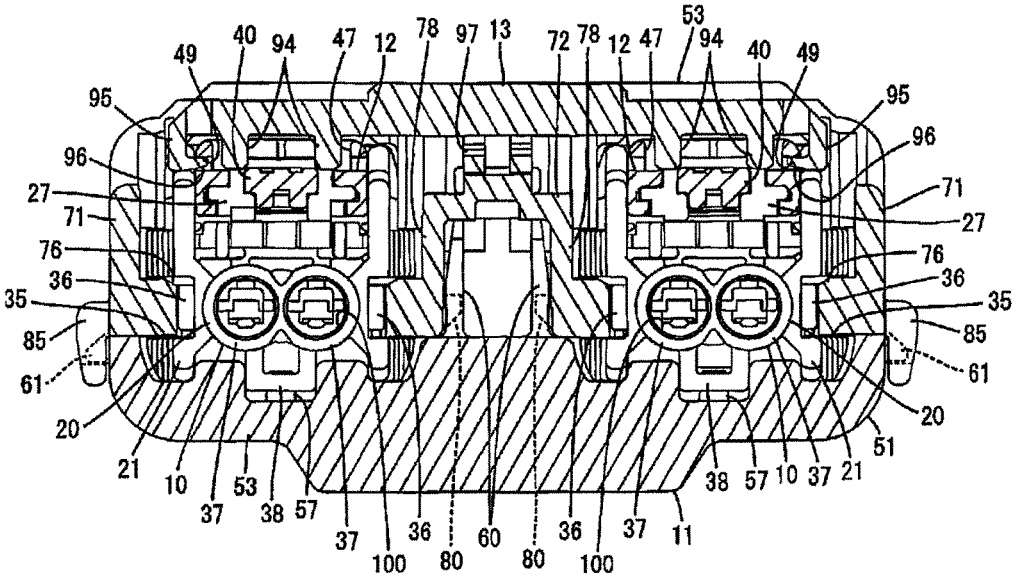
FIG. 11 is a sectional view cut along a line Y-Y in FIG. 9.
Figure 27:
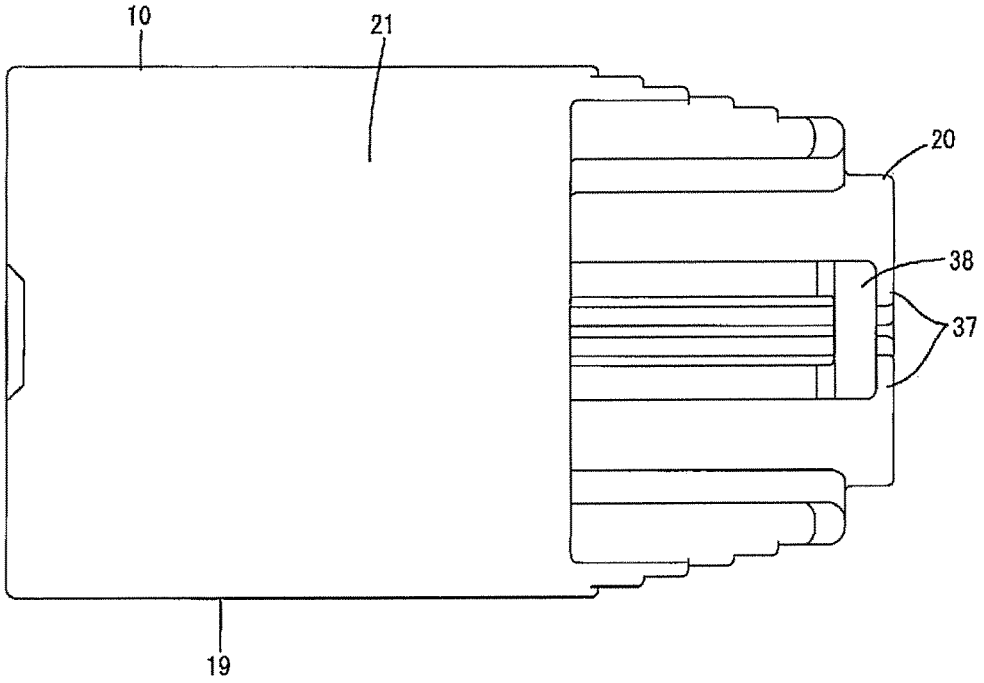
FIG. 27 is a bottom view of the connector of FIG. 22.

As shown in FIG. 11 and FIG. 27, the housing main body 20 may have a pair of cavity tower portions 37 arranged horizontally side by side at the rear end. A locking projection 38 may be provided on the lower surface of both the cavity tower portions 37.

The detecting member 12 may be made of a synthetic resin, and may be movably attached to the arm portion 28 of the locking arm 27. As shown in FIGS. 28 to 31, the detecting member 12 may have a base portion 39, an elastic locking portion 40, a pair of guide portions 41, and a cover portion 42. The base portion 39 may extend laterally from the rear end of the detecting member 12. The elastic locking portion 40 may have a shape extending forward from the center of the front surface of the base portion 39, and can be bent in the vertical direction with respect to the rear end as a supporting point. The elastic locking portion 40 may have a stopper 43 protruding downward at the front end.

Figure 29:
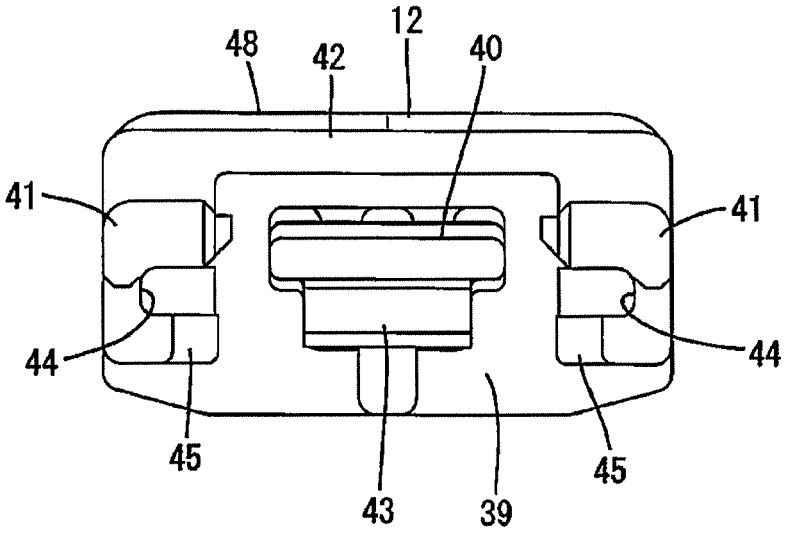
FIG. 29 is a front view of the detecting member of FIG. 22.

The pair of guide portions 41 may have a shape extending forward from both ends of the front surface of the base portion 39, and may not be substantially bent. As shown in FIG. 29, the pair of guide portions 41 may have guide grooves 44 extending in the front-rear direction on the inner surfaces (the facing surfaces of the pair of guide portions 41). Also, the pair of guide portions 41 may have a pair of stopper portions 45 protruding inwardly below the guide grooves 44.

Figure 28:
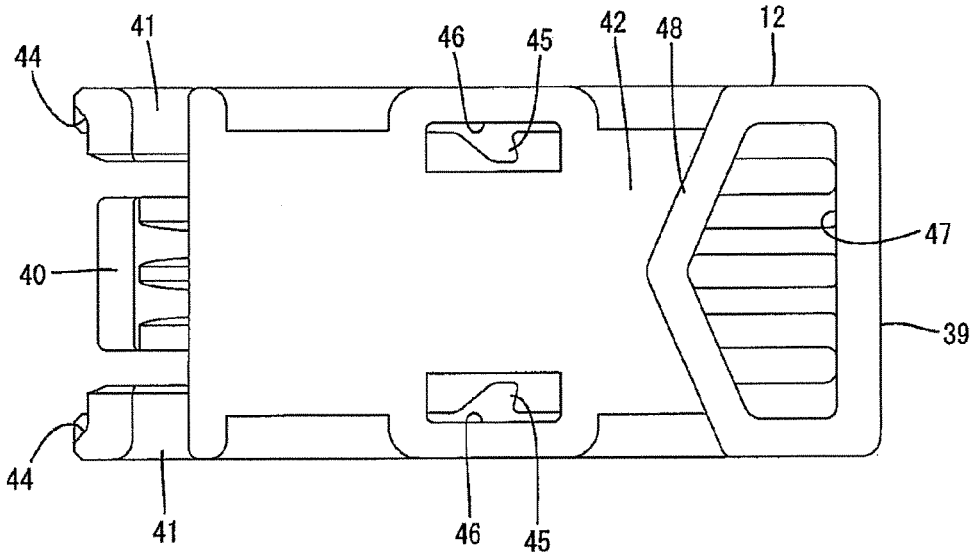
FIG. 28 is a plan view of the detecting member of FIG. 22.

As shown in FIG. 28, the cover portion 42 may be interposed between the upper ends of the pair of guide portions 41 to cover the upper side of the elastic locking portion 40. The cover portion 42 may have a pair of die-out holes 46 at the both ends. The stopper portion 45 can be visually checked from above through the die-out hole 46. The cover portion 42 may include a window hole 47 at the rear end, and a frame portion 48 at the upper circumference of the window hole 47. The window hole 47 may have an opening width corresponding to the distance between the pair of guide portions 41. As shown in FIG. 22, the frame portion 48 may be formed in the shape of a rib surrounding the opening of the window hole 47 over the entire circumference.

Figure 30:
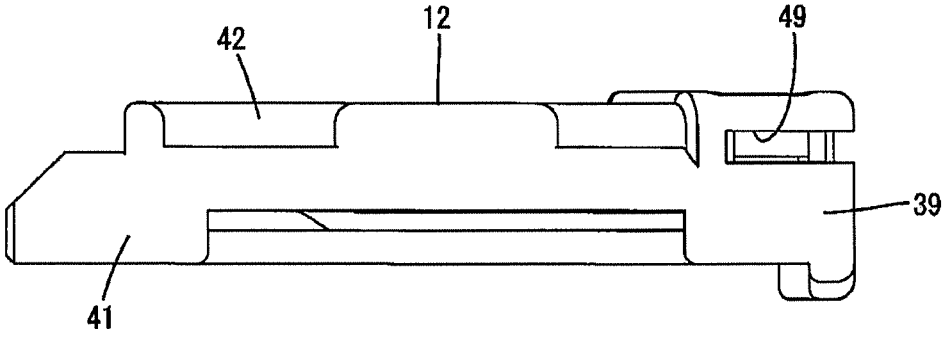
FIG. 30 is a side view of the detecting member of FIG. 22.
Figure 31:
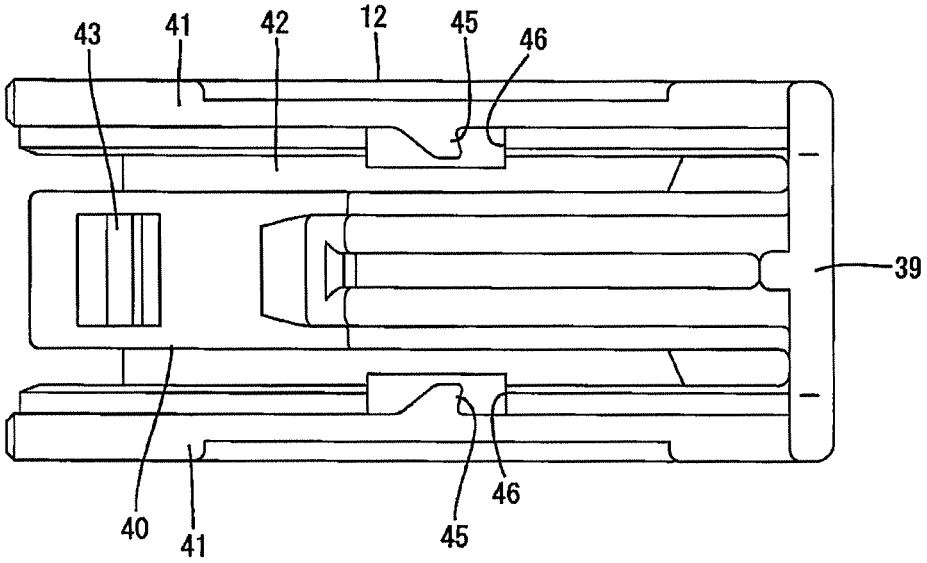
FIG. 31 is a bottom view of the detecting member of FIG. 22.

As shown in FIG. 30, the detecting member 12 may have a stopping groove 49 extending from the rear surface of the base portion 39 to the outer surfaces of the pair of guide portions 41. The stopping groove 49 may extend laterally from the rear surface of the base portion 39, and extend in the front-back direction from the outer surfaces of the pair of guide portions 41, while being at the same height position as the upper end portion of the detecting member 12.

Figure 17:
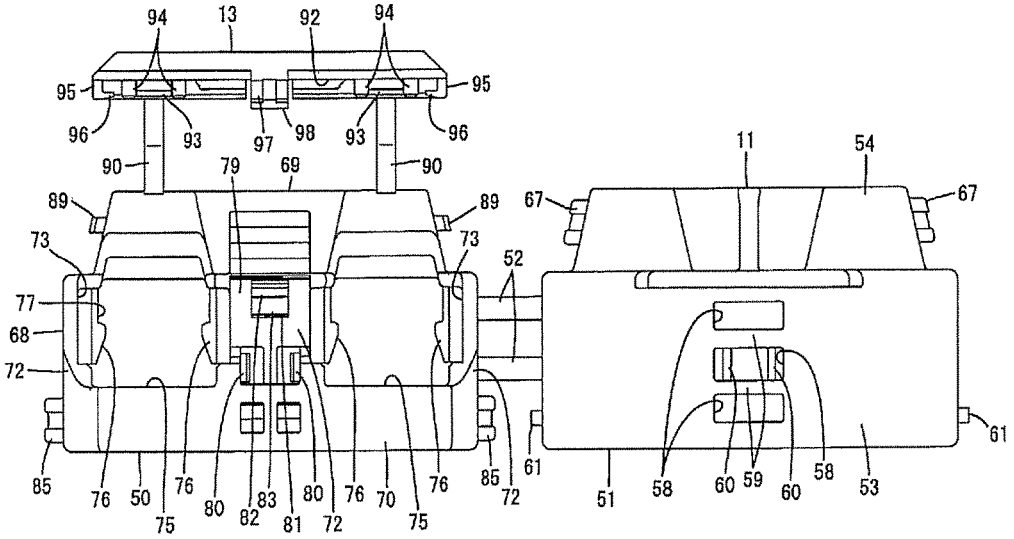
FIG. 17 is a plan view of a holder in an open state according to an embodiment of the present disclosure.

As shown in FIG. 17, the holder 11 may be made of a synthetic resin, and have a pair of halves 50 and 51. The halves 50 and 51 may be engaged with each other through a hinge (hereinafter, referred to as a halves connecting hinge 52).

Figure 2:
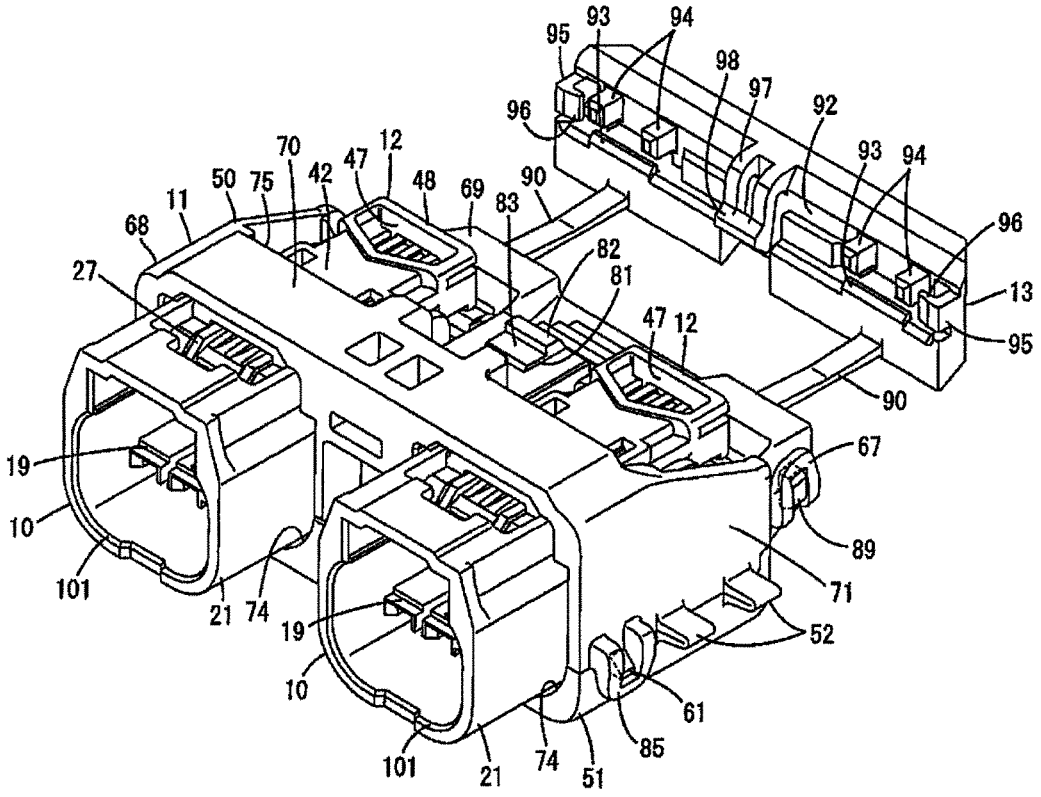
FIG. 2 is a perspective view showing a state in which a lower holder is locked to the upper holder in the state of FIG. 1.
Figure 3:
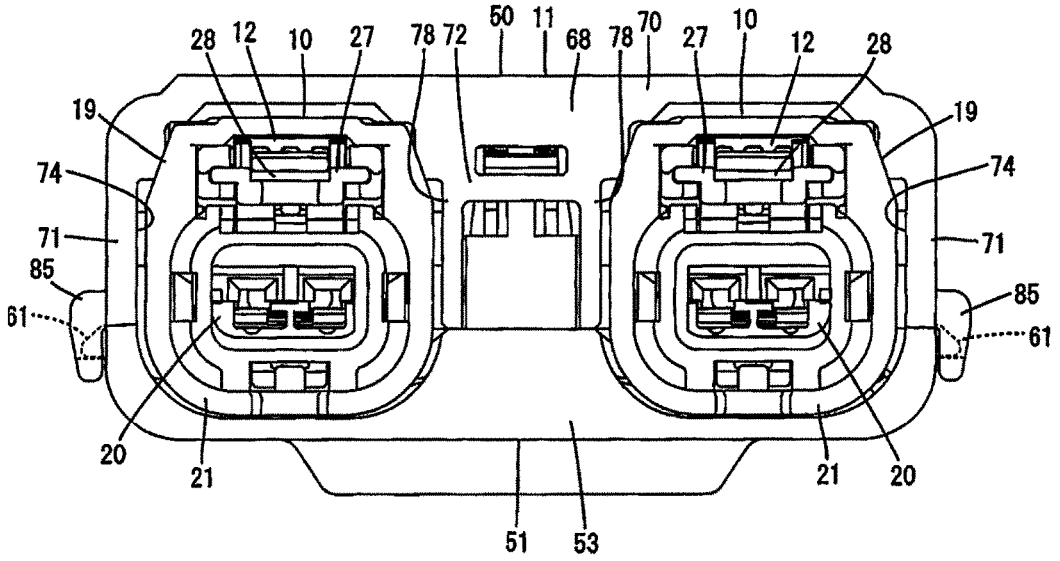
FIG. 3 is a front view of FIG. 2.
Figure 4:
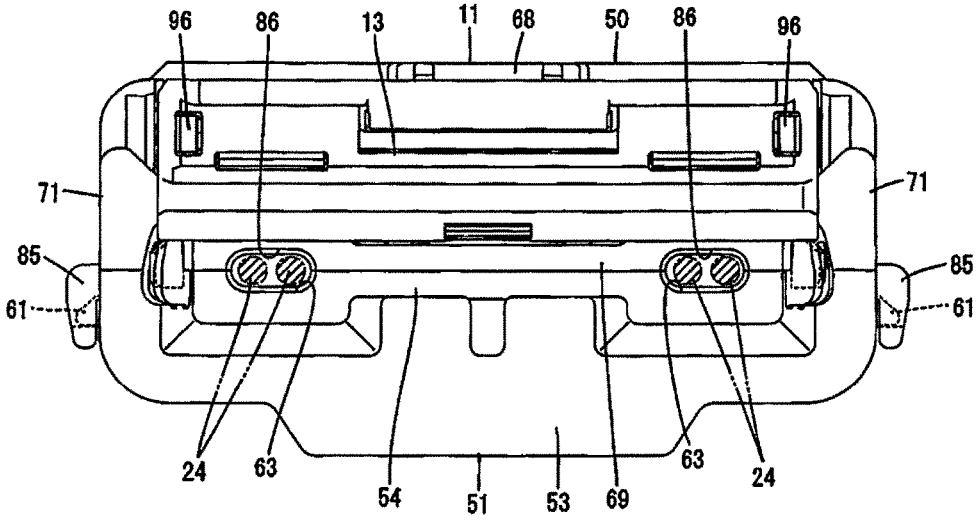
FIG. 4 is a rear view of FIG. 2.
Figure 9:
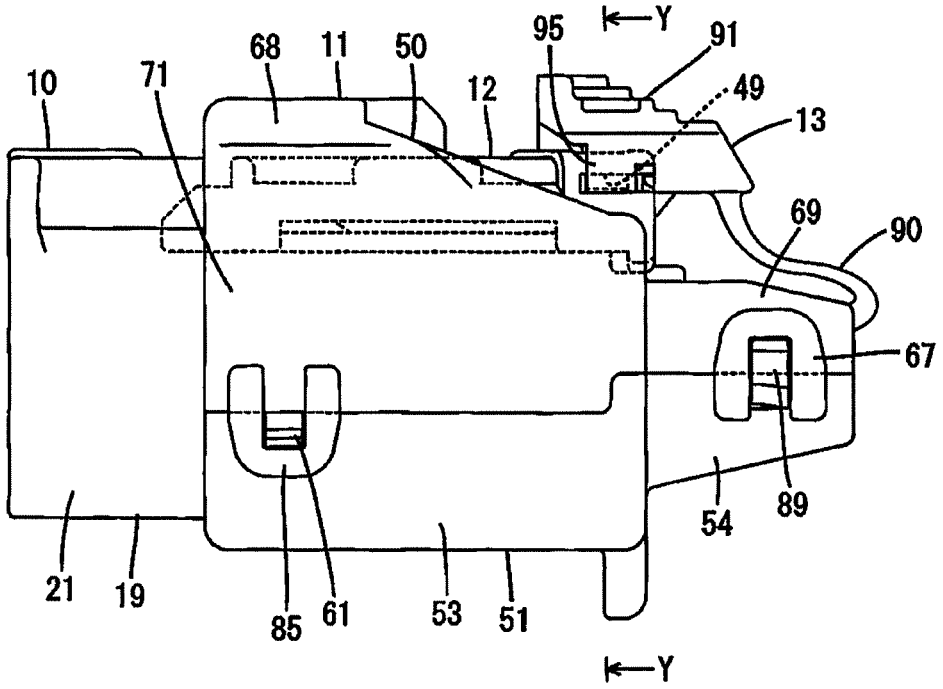
FIG. 9 is a side view of FIG. 7.

As shown in FIGS. 2, 3 and 9, each of the halves 50 and 51 may be composed of an upper holder 50 located on the upper side and a lower holder 51 located on the lower side. The upper holder 50 and the lower holder 51 may be coupled or separated in the vertical direction. In the following description, the vertical direction of the upper holder 50 and the lower holder 51 may be defined based on the position when the upper holder 50 and the lower holder 51 are coupled.

Figure 20:
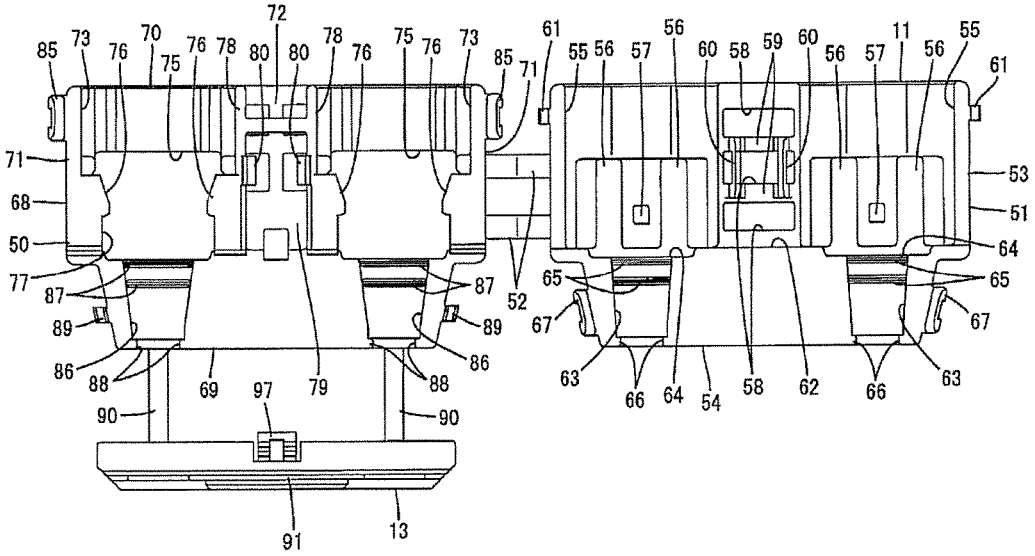
FIG. 20 is a bottom view of the holder in the open state of FIG. 17.

As shown in FIG. 20, the lower holder 51 may include a lower connector accommodating portion 53 and a lower wire cover portion 54 located behind the lower connector accommodating portion 53. The lower connector accommodating portion 53 may have a pair of lower concave surfaces 55 on both the left and right sides of the inner surface (the surface facing the inner side in the coupled state). The lower concave surface 55 may have a shape substantially corresponding to the outer surface of the lower end of the connector 10. The rear portion of the lower concave surface 55 may be located higher than the front portion, and have a pair of left and right protrusions 56. The protrusions 56 may extend in parallel in the front-rear direction. A lower locking portion 57 may protrude between the protrusions 56 of the lower concave surface 55.

Figure 19:
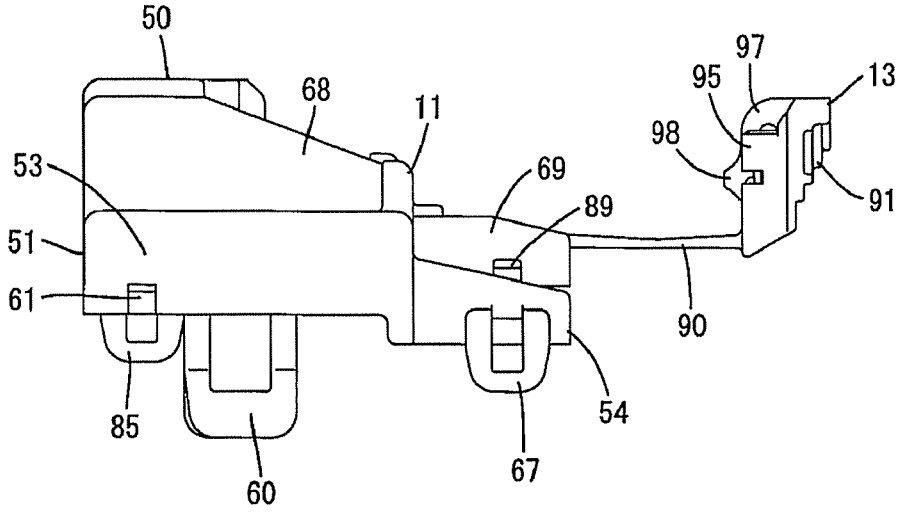
FIG. 19 is a side view of the holder in the open state of FIG. 17.

The bottom wall of the lower connector accommodating portion 53 may include three thickness exception portions 58 in the front-rear direction at the right and left central portions between the lower concave surfaces 55, and have a pair of bridging ribs 59 between the thickness exception portions 58. The lower connector accommodating portion 53 may have a pair of left and right lower central holder locking portions 60 protruding upward from the bottom wall at the left and right central portions. The lower center holder locking portion 60 may be in the shape of a plate frame having a portion penetrating in a lateral direction (thickness direction) (see FIG. 19), and may extend over the bridging ribs 59.

Both side walls of the lower connector accommodating portion 53 may have a pair of lower holder locking projections 61 at the front end of the outer side. The lower holder locking protrusion 61 may have a shape protruding slightly in the lateral direction.

Figure 18:
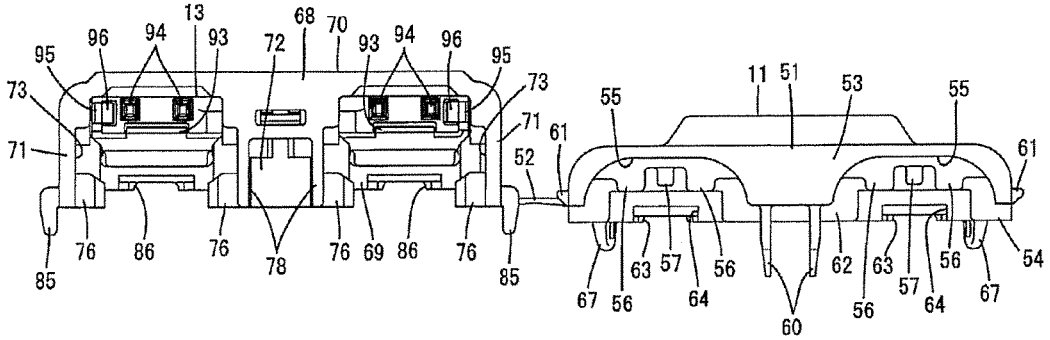
FIG. 18 is a front view of the holder in the open state of FIG. 17.

As shown in FIGS. 18 and 20, the lower connector accommodating portion 53 and the lower wire cover portion 54 may be partitioned by a vertical wall portion 62 extending in the left-right direction. As shown in FIG. 20, the lower wire cover portion 54 may protrude backward from the upper end of the vertical wall portion 62, and may be formed in the shape of a horizontal plate extending laterally. The lower wire cover portion 54 may have a pair of lower wire insertion grooves 63 on the left and right sides of the upper surface. The lower wire insertion groove 63 may extend in the front-rear direction as a whole. The width of the lower wire insertion groove 63 may be gradually narrowed in the rear direction. In addition, the depth of the lower wire insertion groove 63 may become deeper in the front direction (see FIG. 5). The front end of the lower wire insertion groove 63 may open to the inside of the lower connector accommodating portion 53 through a cut-out portion 64 formed in the upper end of the vertical wall portion 62. The upper surface of the lower wire cover portion 54 excluding both the lower wire insertion grooves 63 may be flat horizontally (see FIG. 4).

As shown in FIG. 20, the lower wire cover portion 54 may have a pair of front and rear lower contact pieces 65 on the front end of the bottom surface of the lower wire insertion groove 63. Both the lower contact pieces 65 may be in the shape of a rib having a triangular cross section, extending in the lateral direction (see FIG. 10), and may be arranged parallel to each other with an interval in the front and rear direction. The lower contact piece 65 on the front side may be formed continuously with the cut-out portion 64 of the vertical wall portion 62. The upper ends of the lower leg portions 65 may be positioned at the same height, and arranged linearly laterally. The lower wire cover portion 54 may have a lower end corner rib 66 having a substantially U-shaped cross section, extending laterally on the rear end of the groove bottom surface of the lower wire insertion groove 63.

Figure 21:
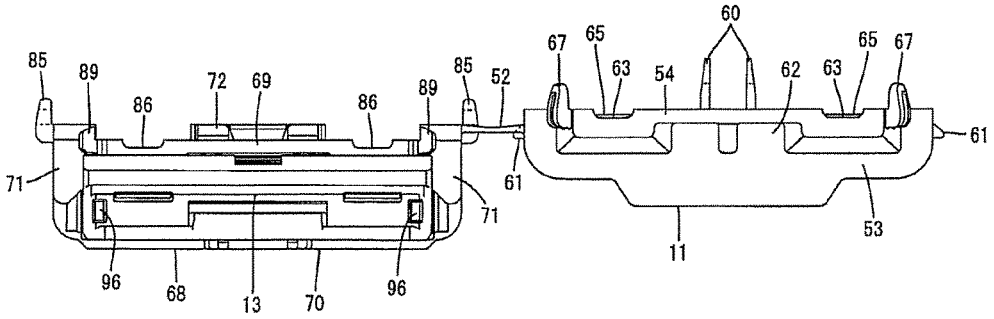
FIG. 21 is a rear view of the holder in the open state of FIG. 17.

As shown in FIG. 21, the lower wire cover portion 54 may have a pair of lower holder locking pieces 67 at both the left and right ends. The lower holder locking piece 67 may protrude upward from the side end of the lower wire cover portion 54, and may be formed in the shape of a plate frame having a portion penetrating in the left-right direction (thickness direction) (see FIG. 19).

As shown in FIGS. 17 and 20, the upper holder 50 may include an upper connector accommodating portion 68 and an upper wire cover portion 69 located behind the upper connector accommodating portion 68. As shown in FIG. 18, the upper connector accommodating portion 68 may have a ceiling wall 70, side walls 71, and a center wall 72. The ceiling wall 70 may constitute the upper portion of the upper holder 50. The side walls 71 may form a pair to protrude downward from the left and right ends of the ceiling wall 70, and constitute the lateral sides of the upper holder 50. The center wall 72 may protrude downward from the left and right central portions of the ceiling wall 70, and partition the inside of the upper holder 50 into left and right portions. The ceiling wall 70, the side walls 71 and the center wall 72 may each have an upper concave surface 73 on the inner lateral surface (the surface facing the inner side in the coupled state). The upper concave surface 73 may have a shape corresponding to the upper outer surface of the connector 10, and may be arranged in pair on both right and left sides of the center wall 72 in the upper connector accommodating portion 68. When the upper holder 50 and the lower holder 51 are coupled, the upper and lower concave surfaces 73 and 55 may be continuous in the circumferential direction, and a pair of left and right connector accommodating space 74 may be defined therein (see FIG. 3).

The ceiling wall 70 may be formed in the shape of a base plate extending laterally. The upper holder 50 may have a pair of right and left openings 75 penetrating in the vertical direction behind the ceiling wall 70. The opening 75 may be partitioned between the ceiling wall 70, the side walls 71, the center wall 72, and the upper wire cover portion 69. When the connector 10 is accommodated in the connector accommodating space 74, the detecting member 12 may be exposed upward through the opening 75 (see FIG. 2).

As shown in FIGS. 17 and 20, both the side walls 71 and the center wall 72 may have a pair of upper locking portions 76 at the rear lower end of the upper concave surface 73. Both the upper locking portions 76 may have a protruding shape in such a way to face each other toward the inside (toward the connector accommodating space 74). More specifically, both the upper locking portions 76 may be formed in the shape of a rib extending in the front-rear direction, and have a cut-out shaped stopping recessed portion 77 on the inner surface of the rear end (surface that both the upper locking portions 76 face). The upper and lower surfaces of the upper locking portion 76 may be flat in the front-rear direction. The upper surface of the upper locking portion 76 can be visually checked through the opening 75.

As shown in FIG. 20, the center wall 72 may have a pair of left and right opposed wall portions 78 and a base wall portion 79. The opposed wall portions 78 may be formed in the shape of a plate that is flat in the front-rear direction, and arranged to face each other in the left-right direction. The opposed wall portions 78 may have an upper center holder locking portion 80 on the inner surfaces (surfaces that the opposed wall portions 78 face). The upper center holder locking portion 80 may have a shape protruding slightly toward the inside. The upper locking portion 76 may be provided on the outer surface of the opposed wall portion 78.

Figure 15:
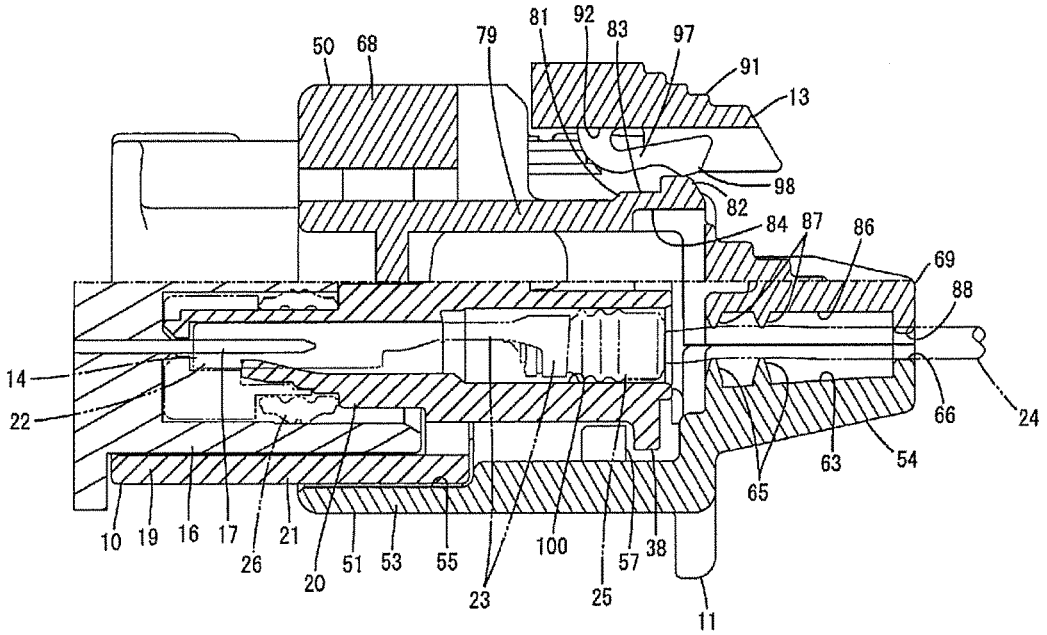
FIG. 15 is a view showing a state where a locking piece and a sound generating portion are cut to a visible position in the state of FIG. 13.
Figure 16:
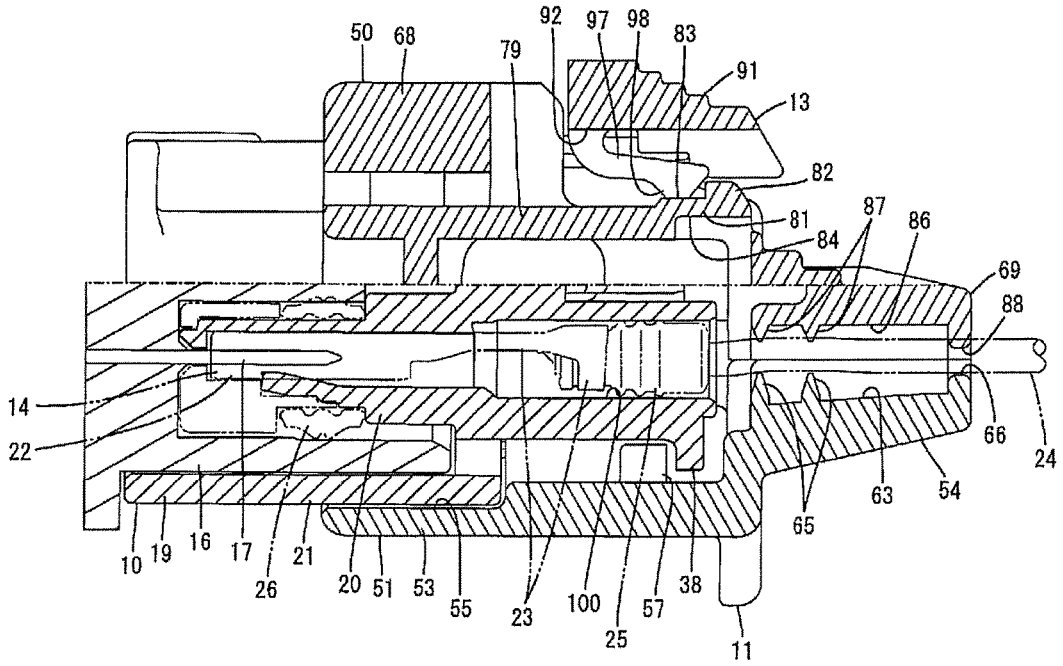
FIG. 16 is a view showing a state where a locking piece and a sound generating portion are cut to a visible position in the state of FIG. 14.

The base wall portion 79 may be disposed between the opposed wall portions 78, and arranged horizontally such that the wall surfaces face the up and down directions. As shown in FIGS. 2, 15 and 16, the base wall portion 79 may have a sound generating portion 81 at the rear end of the upper surface. The sound generating portion 81 may be located higher than the surrounding portion. The sound generating portion 81 may have an operating member locking portion 82 protruding upward from the rear end of the upper surface. A portion of the upper surface of the sound generating portion 81 which is ahead of the operating member locking portion 82 may be a collision receiving surface 83 which is flat along the front-rear direction. The front surface of the operating member locking portion 82 may be arranged along the vertical direction so as to be orthogonal to the collision receiving surface 83. The base wall portion 79 may have a resonance space portion 84 below the sound generating portion 81. The resonance space portion 84 may extend in the front-rear direction to open to the rear end of the base wall portion 79.

Both the side walls 71 may have a pair of upper holder locking pieces 85 at the front ends of the left and right outer side surfaces. The upper holder locking piece 85 may be formed in the shape of a plate frame protruding downward from the outer side surface of the side wall 71 and having a portion penetrating in the lateral direction (the thickness direction of the plate) (see FIG. 19).

The upper wire cover portion 69 may be formed in the shape of a horizontal plate extending laterally. As shown in FIG. 20, the front end of the upper wire cover portion 69 may be connected to the rear ends of both the side end walls 71 and the rear end of the center wall 72, respectively. The upper wire cover portion 69 may have a pair of upper wire insertion grooves 86 on the left and right sides of the lower surface. The upper wire insertion grooves 86 may extend in the front-rear direction as a whole, and the width of each upper wire insertion groove 86 may be gradually narrowed in the rear direction. The front end of the upper wire insertion groove 86 may open to the connector accommodating space 74. A portion of the lower surface of the upper wire cover portion 69 excluding the upper wire insertion groove 86 may be flat horizontally (see FIG. 4).

The upper wire cover portion 69 may have a pair of front and rear upper contact pieces 87 at the front end of the bottom surface of the upper wire insertion groove 86. Each of the upper contact pieces 87 may be formed in the shape of a rib having a substantially triangular cross section (see FIG. 10), and may be arranged in parallel with an interval in the front-rear direction. The front side of the upper contact piece 87 may face the connector accommodating space 74 at the front end of the upper wire cover portion 69. The lower ends of both the upper contact pieces 87 may be positioned at the same height, and arranged linearly in the left and right direction. The upper wire cover portion 69 may have an upper end corner rib 88 being substantially U-shaped in and extending laterally to the rear end of the groove bottom surface of the upper wire insertion groove 86.

The upper wire cover portion 69 may have a pair of upper holder locking projections 89 at both the left and right ends. The upper holder locking projection 89 may have a shape protruding slightly in the lateral direction.

Between the side wall 71 of the upper holder 50 and the side wall of the lower holder 51, a pair of front and rear half connecting hinges 52 may be provided. Both the half connecting hinges 52 may be in the shape of a flexible band and arranged parallel to each other. As shown in FIG. 20, in the state where the upper holder 50 and the lower holder 51 are arranged side by side (also, in a separated state or in a molded state), both the half connecting hinges 52 may extend in the left-right direction.

The operating member 13 may be made of a synthetic resin, and formed in the shape of a plate piece extending in the left-right direction, as shown in FIG. 1. The operating member 13 may be connected to and integrated with the holder 11 through a hinge (hereinafter, referred to as operating member connecting hinge 90). As shown in FIG. 20, a pair of operating member connecting hinges 90 may be disposed in the left-right direction between the operating member 13 and the upper wire cover portion 69. When the upper holder 50 and the lower holder 51 are in the separated state, the plate surfaces of the operating member 13 may be disposed in the front and rear directions, and one end of the operating member connecting hinge 90 may be connected to the left or right ends of the plate surface disposed in the front direction. The other end of the operating member connection hinge 90 may be connected to a portion corresponding to the rear end of the upper wire insertion groove 86 of the upper wire cover portion 69.

Figure 7:
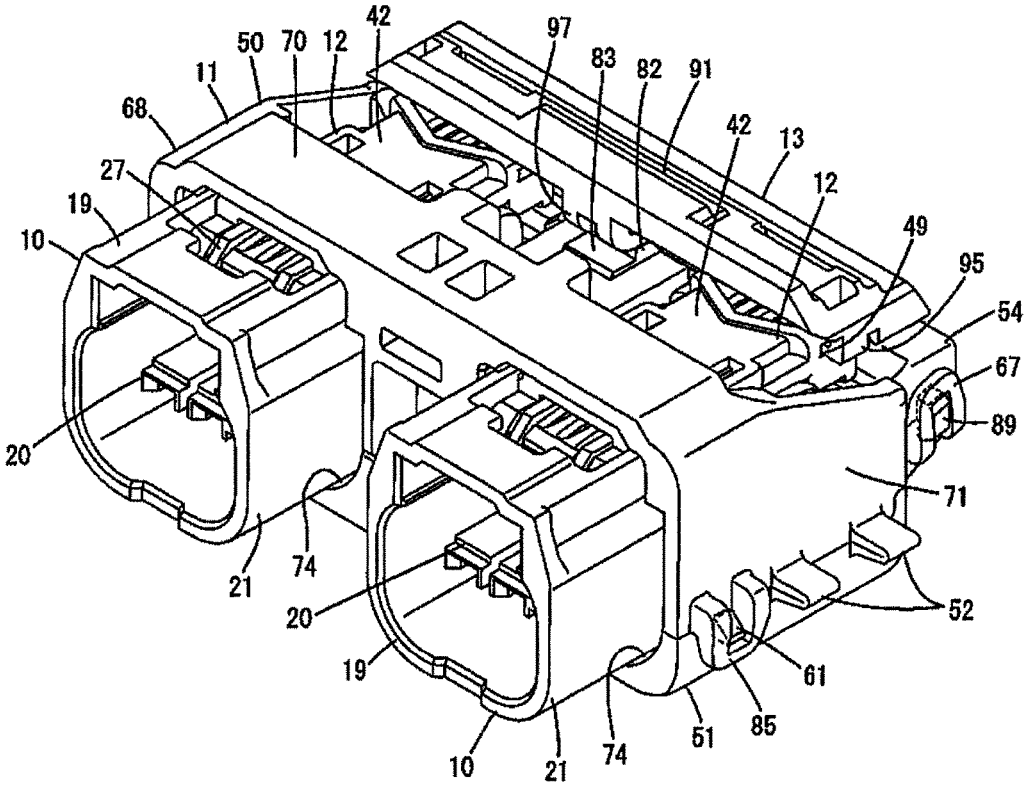
FIG. 7 is a perspective view showing a state in which an operating member is engaged with a detecting member in the state of FIG. 2.
Figure 8:
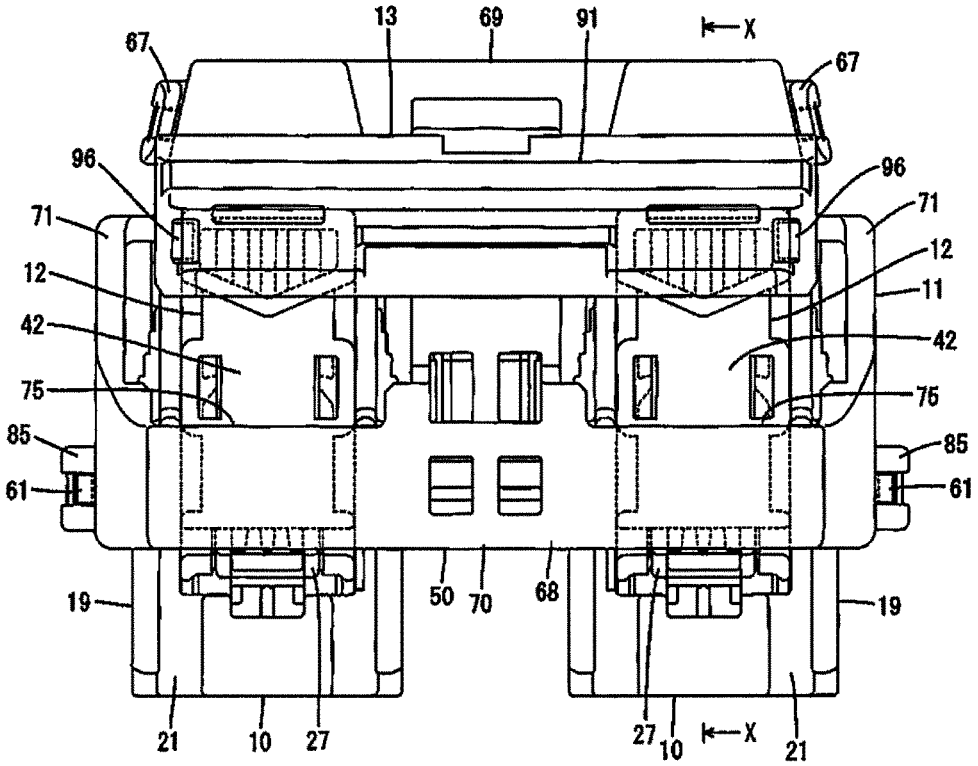
FIG. 8 is a plan view of FIG. 7.

The operating member 13 may come into contact with the detecting member 12 from behind, and push the detecting member 12 forward with respect to the connector 10 to move it to the detecting position. In the following description, the up-and-down direction and the back-and-forth direction of the operating member 13 may be defined based on the position (the state shown in FIG. 7) of the operating member 13 when the detecting member 12 is pressed. The plate surface (the surface to which the one end of the operating member connecting hinge 90 is connected) facing the front of the operating member 13 may correspond to the lower surface of the operating member 13.

As shown in FIG. 9, the upper surface of the operating member 13 as a whole may be formed in the shape of an inclined surface inclined upward toward the front. On the upper surface of the operating member 13, a non-slip portion 91 may be provided by a plurality of grooves extending in the left-right direction (see FIG. 20).

Figure 5:
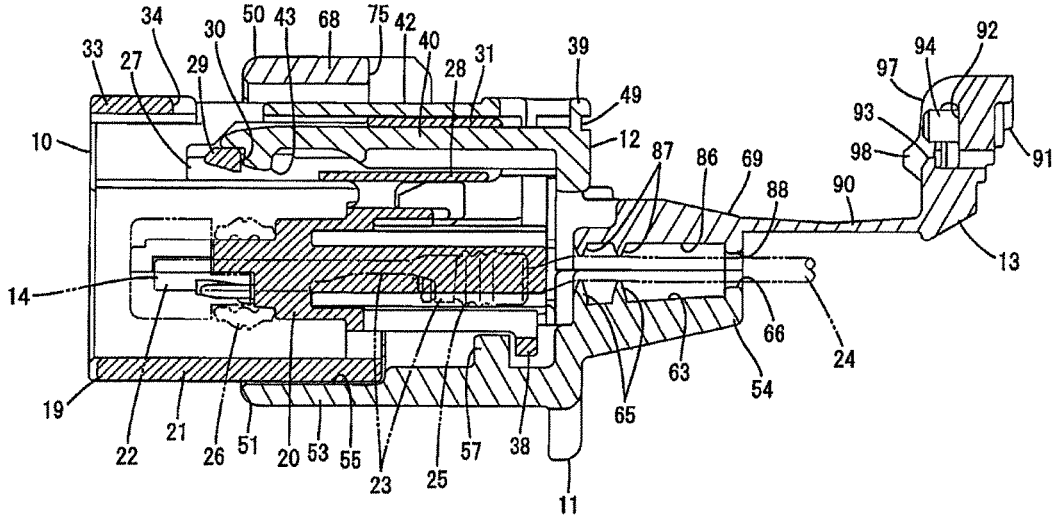
FIG. 5 is a side sectional view (sectional view in the side direction) of FIG. 2.

As shown in FIGS. 5 and 17, the operating member 13 may have a cut-out type press-fit recessed portion 92 at a connection portion between the lower surface and the front surface. The press-fit recessed portion 92 may have a substantially L-shaped in cross section, wherein the inner side surface (the surface toward the front direction) may be disposed substantially along the vertical direction, and the inner upper surface (the surface facing downward) may be disposed substantially along the front-rear direction.

The press-fit recessed portion 92 may have a pair of stopping protrusions 93 at both the left and right ends of the lower end of the inner surface. The stopping protrusion 93 may be formed in the shape of a rib extending in the left-right direction. The press-fit recessed portion 92 may have a pair of left and right protruding portions 94 at both the left and right ends of the inner surface. Each protruding portion 94 may be formed in the shape of a square pillar.

As shown in FIG. 17, the press-fit recessed portion 92 may have elastic retaining pieces 95 at the left and right outer sides of the inner surface. The elastic retaining pieces 95 may be exposed in pair at the left and right ends of the operating member 13. The elastic retaining piece 95 may protrude downward from the inner upper surface of the press-fit recessed portion 92, and have a retaining protrusion 96 protruding inwardly from the lower end portion (the opposed directions of both the elastic retaining pieces 95).

The press-fit recessed portion 92 may have a locking piece 97 (striking portion) on the right and left central portion of the inner surface. As shown in FIG. 16, the locking piece 97 may protrude downward from the inner surface of the press-fit recess portion 92, and then extend rearward. The locking piece 97 can be bent in the vertical direction with respect to the front end portion as a supporting point. The locking piece 97 may have a projection 98 projecting downward at the rear end. The lower surface of the projection 98 may be a flat surface along the front-rear direction. The front surface of the projection 98 may be formed in the shape of an inclined surface inclined rearward toward the down direction. In addition, the rear surface of the projection 98 may be formed in the shape of an inclined surface shape inclining forward toward the down direction. As shown in FIG. 1, the locking piece 97 may protrude from the inner surface of the press-fit recessed portion 92 in a bifurcated shape, and the bifurcated portion may be connected through the projection 98.

The structure of the connector device according to the first embodiment of the present disclosure has been described above. Hereinafter, a method of assembling the connector device, and a method of disengaging the connector device will be described.

First, the detecting member 12 may be attached to the locking arm 27 of the connector 10 from behind. At this time, the pair of rail portions 32 of the arm portion 28 may be inserted into the guide grooves 44 of the pair of guide portions 41 (see FIG. 24) so that the upper plate portion 31 may be disposed between the elastic locking portion 40 and the cover portion 42 (see FIG. 5). In addition, the stopper portion 45 may be disposed so as to be engageable with the leg portion 99 from the front. The stopper 43 of the elastic locking portion 40 may enter the locking hole 30 of the arm portion 28 so that the stopper 43 may be disposed to be engageable with the locking body portion 29 from the rear. As a result, the detecting member 12 may be kept to be prevented from moving to the standby position with respect to the connector 10.

Subsequently, the two connectors 10 may be held in the upper holder 50 (see FIG. 1). The upper portion of the connector 10 may be inserted into the upper concave surface 73 of the upper holder 50 from the front. In the process of inserting the upper portion of the connector 10 into the upper concave surface 73, both the locking projections 36 may interfere with the upper locking portion 76, and as a result, the side wall 71 and the opposite wall portion 78 may be bent. When the upper portion of the connector 10 is normally inserted into the upper concave surface 73, the side wall 71 and the opposite wall portion 78 may elastically return to the original state. The upper locking portion 76 may be inserted into the locking groove 35 of the connector 10, and the locking projection 36 may be inserted into the stopping recessed portion 77, so that the upper locking portion 76 may be engaged with the locking projection 36 (see FIG. 6). The connector 10 may be arranged in front of the upper wire cover portion 69 so as to face each other. Both the upper and lower surfaces of the upper locking portion 76 may be disposed so as to be able to contact the upper and lower groove surfaces of the locking groove 35 (see FIG. 11). Thus, when the holder 11 is in the separated state, the connector 10 may be maintained in a state where it is prevented from pulling out of the upper concave surface 73 of the upper holder 50.

Subsequently, the lower holder 51 may be pivoted through the half connecting hinge 52, and coupled with the upper holder 50. The lower holder locking projection 61 may be elastically hooked to the upper holder locking piece 85, and the upper holder locking projections 89 may be elastically hooked to the lower holder locking piece 67 (see FIG. 9). In addition, the upper central holder locking portion 80 may be elastically hooked to the lower central holder locking portion 60 (see FIG. 11). As a result, the lower holder 51 and the upper holder 50 may be strongly held in a coupled state.

When the upper holder 50 and the lower holder 51 are coupled, a pair of left and right connector accommodating space 74 may be divided, and the connectors 10 may be respectively accommodated in both the connector accommodating space 74 (see FIG. 2 and FIG. 3). At this time, the locking projections 38 may enter space surrounded by the lower locking portions 57, the vertical wall portions 62, and the protruding portions 56 of the lower holder 51 (see FIG. 20). The locking projection 38 may be arranged so as to be engageable with the lower locking portion 57 (see FIG. 5), and as already described above, the upper locking portion 76 may be arranged to be engageable with the locking projection 36 (See FIG. 6), so that the connector 10 may be prevented from coming out of the holder 11 forward.

The connector 10 may have a rattle between the upper concave surface 73 and the lower concave surface 55, and may be inserted with a sufficient clearance in the vertical and lateral directions into the connector accommodating space portion 74 of the holder 11. Therefore, the connector 10 may be allowed to move slightly in the vertical direction and the lateral direction in the connector accommodating space portion 74 of the holder 11.

In the state where both the connectors 10 are held by the holder 11, the front portions of both the connectors 10 may be disposed so as to be exposed forward from the front end of the holder 11, and the front ends of both the connectors 10 may be disposed at the same position in the front and rear direction. In addition, the detecting member 12 may be disposed so as to be exposed to the opening 75 of the upper holder 50.

When the upper holder 50 and the lower holder 51 are coupled, the lower wire cover portion 54 and the upper wire cover portion 69 may overlap in the vertical direction. The flat upper surface of the lower wire insertion groove 63 and the flat lower surface of the upper wire insertion groove 86 may be brought into close contact with each other along the left and right sides (see FIG. 4). Each of electric wires 24 drawn out from the connector 10 may be arranged side by side in a line between the lower wire insertion groove 63 and the upper wire insertion groove 86. At this time, the lower contact piece 65 and the upper contact piece 87 may be disposed at the same position in the front-rear direction, and the lower contact piece 65 may contact the lower portion of each of the electric wires 24, and the upper contact piece 87 may contact the upper portion of each of the electric wires 24, so that the electric wires 24 are inserted in the vertical direction between the lower contact piece 65 and the upper contact piece 87 (see FIG. 5).

Subsequently, the holder 11 may be gripped and the two connectors 10 held by the holder 11 may be disposed substantially in the frontal position with respect to the two mating connectors 15 provided in one cylinder. In this state, the holder 11 may come close to the mating connector 15. Then, the two connectors 10 may be collectively fitted to the mating connectors 15 through the holder 11. In the fitting process, the connector 10 may come into contact with the front end of the lower wire cover portion 54 and the front end of the upper wire cover portion 69, so that the pressing force from the mating connector 15 is received.

In this case, it is difficult to constantly maintain the distance in the alignment direction of the two mating connectors 15 provided in one cylinder, and there is a problem that the distance between products tends to vary. In consideration of this, in the first embodiment, as described above, both the connectors 10 may be accommodated in the connector accommodating space 74 of the holder 11 so as to be movable in the left-right direction and the up-down direction. For this, when the connectors 10 start being fitted to the mating connectors 15, the hood portions **16*s* of the mating connectors 15 may slide on a guide surface 101 (see FIG. 2) provided on the front-end opening protrusion of the fitting tube portion 21, so that the connectors 10 move in the left-right direction and in the up-down direction to be able to be fitted to the mating connectors 15. As a result, a change in distance of the mating connectors 15 may be absorbed so that the connectors 10 can be smoothly fitted to the mating connectors 15**.

When the fitting of the connector 10 and the mating connector 15 is completed, the tub 17 of the mating terminal fitting 14 may be inserted at a normal depth into the connecting portion 22 of the terminal fitting 14, so that the terminal fitting 14 is electrically connected to the mating terminal fitting. When the fitting of the connector 10 and the mating connector 15 is completed, the mating locking portion 18 may be disengaged from the lower side of the locking hole 30 of the locking arm 27, the stopper 43 may be pushed up to the mating locking portion 18, and the elastic locking portion 40 may be bent, so that the engaging of the stopper 43 and the locking body portion 29 may be released (see FIG. 12). As a result, the detecting member 12 may become movable to the detecting position.

The operating member 13 may move forward while bending the operating member connecting hinge 90 at a proper timing before the fitting of the connector 10 and the mating connector 15, so as to arrive at the upper side of the rear end of the detecting member 12. The two connectors 10 may be held side by side in the holder 11, and the respective detecting members 12 may be attached to both the connectors 10 as described above. The operating member 13 may be arranged so as to collectively cover the upper sides of the rear ends of the two detecting members 12 arranged side by side on the left and right sides. In this state, the operating member 13 may be pushed down. Each protruding portion 94 may be inserted into the window hole 47 of the corresponding detecting member 12 from above, both the stopping protrusions 93 may be inserted into the stopping grooves 49 on the rear end side of the corresponding detecting member 12 elastically, and the retaining protrusions 96 provided on both the elastic locking pieces 95 may elastically enter the stopping grooves 49 on the right and left outer sides of the corresponding detecting member 12 (see FIG. 11). Thus, the operating member 13 may be connected to the detecting member 12 to become a substantially integrated state. At this time, the projection 98 of the locking piece 97 may be positioned immediately behind the operating member locking portion 82.

Figure 13:
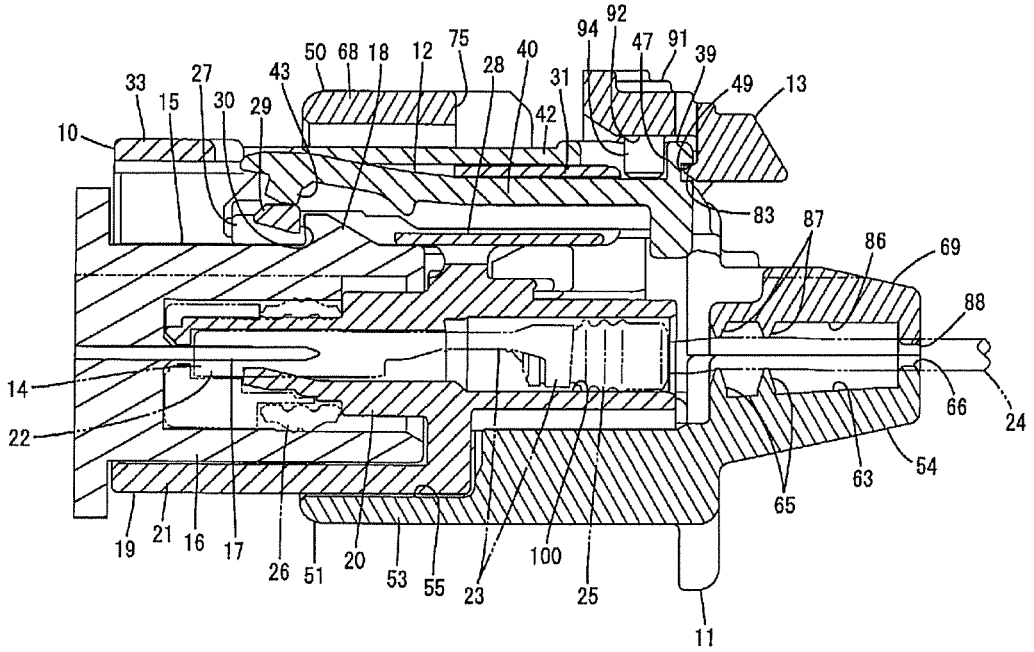
FIG. 13 is a side cross-sectional view for describing a process in which a detecting member moves toward a detecting position in the state of FIG. 12.

In this state, the non-slip portion 91 of the operating member 13 may be pressed from behind. Then, both the detecting members 12 may be pressed by the operating member 13 to move toward the detecting position. In the process in which both the detecting members 12 move toward the detecting position, the stopper 43 may ride over the locking body portion 29 so that the bent state of the elastic locking portion 40 is maintained (see FIG. 13). Further, the projection 98 may ride over the operating member locking portion 82, and the locking piece 97 may be bent and deformed (see FIG. 15). In the process in which both the detecting members 12 move toward the detecting position, the pair of guide portions 41 may slide on the pair of rail portions 32 of the arm portion 28 to guide the movement of both the detecting members 12.

Figure 14:
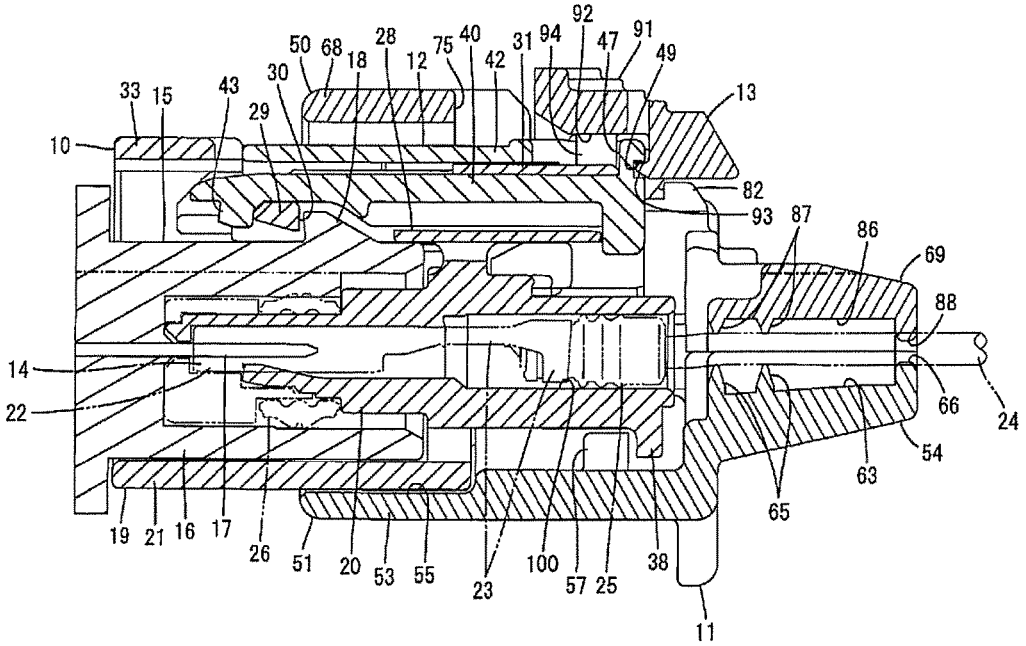
FIG. 14 is a side cross-sectional view showing the detecting member moved to the detecting position in the state of FIG. 13.

Then, when the operating member 13 is press-fitted, both the detecting members 12 may reach the detecting position. In the detecting position, the elastic locking portion 40 may be elastically returned, and the stopper 43 may be arranged so as to be engageable with the locking body portion 29 in the front direction (see FIG. 14). The front end of the cover portion 42 may be disposed so as to be contactable with the wall portion 33 from behind. As a result, both the detecting members 12 may be prevented from moving to the detecting position.

When the detecting member 12 reaches the detecting position so that the front end of the cover portion 42 comes into contact with the rear portion of the wall portion 33, the operating member 13 may be prevented from further being press-fitted. As the detecting members 12 reach the detecting position, the operating member 13 may reach the press-fitting position. When the operating member 13 reaches the press-fitting position, the locking piece 97 may elastically return, and the projection 98 may collide against the collision receiving surface 83 of the sound generating portion 81 (see FIG. 16) so that sound is generated. The generated sound may be resonated in the resonance space portion 84, and output in a state in which the volume is increased. It is possible to judge that the operating member 13 reaches the press-in position and both the detecting members 12 reach the detecting position by receiving the sound generated when the projection 98 hits the collision receiving surface 83. Both the detecting members 12 may reach the detecting position at the same timing.

When the operating member 13 reaches the press-in position, the projection 98 may be disposed so as to be engageable with the operating member locking portion 82 in the front direction. As a result, the movement of the operating member 13 in the backward direction in the press-in position may be restricted.

It may be necessary to separate the connector 10 and the mating connector 15 from each other due to maintenance or the like. When the connector 10 is detached from the mating connector 15, it may be first necessary to return the detecting member 12 to the standby position. In the first embodiment, when returning the detecting member 12 to the standby position, the non-slip portion 91 of the operation member 13 may be pressed from above. Then, the operating member 13 may be pushed down together with the rear end portions of the detecting members 12, so that the front end portion of the elastic locking portion 40 is pulled up and the engagement between the stopper 43 and the locking body portion 29 is released. In this state, a returning force may be applied to the operating member 13 from behind. Then, the rear surface of the projection 98 in the shape of an inclined surface may ride over on the operating member locking portion 82 to release the engagement of the projection 98 and the operating member locking portion 82. When the operating member 13 is retracted, both the detecting members 12 may be retracted simultaneously with the operating member 13, and return to the standby position. Thereafter, the engaging of the locking arm 27 and the mating locking portion 18 may be released, so that the connector 10 is released from the mating connector 15.

As described above, according to the first embodiment, the following operational effects can be exhibited.

(1) Two connectors 10 may be held side by side in the holder 11, and in this state, both the connectors 10 may be collectively fitted to the corresponding mating connectors 15, respectively. Therefore, it is not necessary to perform the fitting operation for each connector 10, resulting in a reduction of workload. As a result, the workability in fitting the connectors can be improved.

(2) The holder 11 may be composed of the pair of halves 50 and 51 composed of the upper holder 50 and the lower holder 51. The two connectors 10 may be easily mounted on the holder 11 because the upper holder 50 and the lower holder 51 are coupled with the two connectors 10 in between.

(3) When the holder 11 is in the separated state, since the two connectors 10 are held with the upper holder 50 in the holding state through the upper locking portion 76, it is possible to prevent displacement of the positions of both the connectors 10 with respect to the upper holder 50 when the upper holder 50 is coupled with the lower holder 51. As a result, the upper holder 50 and the lower holder 51 can be smoothly coupled.

(4) Since the holder 11 includes connector accommodating space 74 for individually accommodating the two connectors 10, and the two connectors 10 are accommodated in the connector accommodating space 74 in such a way to be movable in the left-right direction and the up-down direction respectively, the connector 10 may be guided to a position to which it can be fitted to the mating connector 15 by moving in the left-right direction and the up-down direction in the connector accommodating space 74. As a result, the fitting operation of the connector 10 and the mating connector 15 can be performed smoothly.

(5) Since the upper holder 50 and the lower holder 51 constituting both the halves 50 and 51 are connected to each other via the half connecting hinge 52, the number of parts of the holder 11 can be prevented from increasing.

(6) Since the two connectors 10 are held side by side in the holder 11, the detecting members 12 individually attached to both the connectors 10 in this state may be moved collectively to the detecting position by the operating member 13, it is not necessary to perform the operation of moving the detecting member 12 for each connector 10, and the workability in moving the detecting members 12 to the detecting position can be improved. It is also possible to collectively return both the detecting members 12 to the standby position by pressing the operation member 13 when the detecting member 12 is at the detecting position, and the workability in moving the detecting member 12 to the standby position can be improved.

(7) When the operating member 13 presses the detecting member 12, the stopping groove 49 and the stopping protrusion 93 provided on the opposed surfaces of the operating member 13 and the detecting member 12 may be fitted to each other so that the position of the operating member 13 is prevented from being displaced with respect to the detecting member 12. Therefore, the operability when the operating member 13 presses the detecting member 12 can be improved.

(8) The holder 11 may include the sound generating portion 81, and a locking piece 97 which reaches the press-in position when the operating member 13 moves the detecting member 12 to the detecting position and hits the sound generating portion 81 to generate a sound. Therefore, it can be confirmed that the detecting member 12 is moved to the detecting position by recognizing the sound generated when the locking piece 97 hits the sound generation portion 81.

(9) The locking piece 97 may be locked to the operating member locking portion 82 of the holder 11 so that the operating member 13 is restricted from moving in the returning direction from the press-in position. Therefore, the function of generating sound on the locking piece 97 and the function of restricting the return movement of the operating member 13 may be integrally provided. As a result, the configuration can be simplified as compared with the case where the two functions (the sound generating function and the return movement restricting function) are separately provided.

(10) Since the operating member 13 is connected to the upper holder 50 via the operating member connecting hinge 90, as compared with the case where the operating member 13 and the upper holder 50 are separately provided, the number of parts may be reduced.

(11) When the wire 24 led out to the outside from the holder 11 vibrates, since a portion of the wire in the holder 11 is inserted between the upper contact piece 87 and the lower contact piece 65, the vibrating force of the wire 24 may be prevented from being transmitted to the terminal fitting 14. As a result, it is possible to suppress sliding contact abrasion at the connection portion between the terminal fitting 14 and the mating terminal fitting, thereby improving the connection reliability. More particularly, in the first embodiment, since the vibrating force of the wire 24 is widely dispersed into the holder 11 and the two connectors 10 held by the holder 11, the vibrating force of the wire 24 may be hardly transmitted to the terminal fitting 14 so that the connection reliability can be further improved.

(12) The upper contact piece 87 may be provided on the upper holder 50, and the lower contact piece 65 may be provided on the lower holder 51. Thus, each of the contact pieces 87 and 65 can be easily formed.

Second Embodiment

A second embodiment of the present disclosure will be briefly described below.

(1) The holder may be configured to hold three or more connectors side by side. In this case, the holder may be configured to have three or more connector accommodating space.

(2) Both the halves may be coupled (closed) and separated (opened) in the left-right direction.

(3) The holder may have a structure in which both the halves are mutually separable, without having half connection hinges.

(4) The holder may not have the operating member connecting hinge, and the operating member may be separated from the holder.

(5) When the holder is in the separated state, the connector may be configured to be held in either the upper holder or the lower holder. For example, the lower holder may not have the lower locking portion, and the connector may not be engaged with the lower holder.

(6) The connector may be allowed to move only in the lateral direction (the alignment direction of the connector) in the connector accommodating space of the holder.

(7) The sound generating portion may be provided in the connector housing of the connector.

(8) The wire drawn out to the outside from the connector may be configured to contact only one of the upper contact piece and the lower contact piece to restrict the movement. In this case, the other one of the upper contact piece and the lower contact piece may be omitted.

What is claimed is:

1. A connector device comprising:

a plurality of connectors configured to be fitted to a plurality of mating connectors;

a detecting member configured to move to a standby position or a detecting position with respect to the plurality of connectors and to move to the detecting position when the plurality of connectors are fitted normally to the plurality of mating connectors;

a holder configured to hold the plurality of connectors in parallel; and an operation member configured to move the detecting member individually disposed in the plurality of connectors to the detecting position;

wherein the holder or the connectors includes a sound generating portion, and the operating member includes a striking portion that reaches a press-in position when the detecting member is moved to the detecting position and strikes the sound generating portion at the press-in position to generate a sound.

2. The connector device according to claim 1, wherein stopping portions are provided on mutually opposing surfaces of the operating member and the detecting member to engage with each other when the detecting member is moved to the detecting position.

3. The connector device according to claim 1, wherein the striking portion is engaged with the holder or the connectors, and is a locking piece to restrict movement of the operating member in the returning direction from the press-in position.

4. The connector device according to claim 1, wherein the operating member is connected to the holder through a hinge.

* * * * *